US007608022B2

(12) United States Patent
Lull et al.

(10) Patent No.: US 7,608,022 B2
(45) **Date of Patent: *Oct. 27, 2009**

(54) LEG PRESS AND ABDOMINAL CRUNCH EXERCISE MACHINE

(75) Inventors: Andrew P. Lull, Boulder, CO (US); Gregory P. Webb, Independence, VA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/427,941

(22) Filed: Jun. 30, 2006

(65) Prior Publication Data

US 2006/0240957 A1 Oct. 26, 2006

Related U.S. Application Data

(63) Continuation of application No. 10/211,409, filed on Aug. 1, 2002, now Pat. No. 7,070,545, which is a continuation-in-part of application No. 10/192,330, filed on Jul. 10, 2002, now Pat. No. 7,004,890, which is a continuation-in-part of application No. 10/186,433, filed on Jul. 1, 2002, now Pat. No. 7,150,702.

(51) Int. Cl.
*A63B 21/06* (2006.01)
*A63B 21/062* (2006.01)

(52) U.S. Cl. ..... 482/100; 482/99; 482/135

(58) Field of Classification Search ..... 482/97–103, 482/133–138, 142
See application file for complete search history.

(56) References Cited

U.S. PATENT DOCUMENTS

| | | | |
|---|---|---|---|
| 37,713 | A | 2/1863 | van Houten |
| 43,149 | A | 6/1864 | Wood |
| 108,401 | A | 10/1870 | Smith |

(Continued)

FOREIGN PATENT DOCUMENTS

| | | |
|---|---|---|
| CA | 1 183 882 | 3/1985 |

(Continued)

OTHER PUBLICATIONS

"8300s Series II Strength System," Schwinn Cycling & Fitness Inc., one page of product brochure showing 8300 Series II Strength System, 1 page (1999).

(Continued)

*Primary Examiner*—Fenn C Mathew
(74) *Attorney, Agent, or Firm*—Dorsey & Whitney LLP

(57) ABSTRACT

An exercise machine composed of a frame, a first four bar linkage system, a second four bar linkage system, and a means for transferring an incident force from the legs of a user is disclosed. The first four bar linkage system is operably mounted on the frame and operably connects the transferring means to the frame to allow for back and forth movement of the transferring means along a path of travel about an instantaneously changing axis of rotation. The second four bar linkage system operably engages the first four bar linkage system. Either or both of the first four bar linkage system and the second four bar linkage system are operably connected to a resistance means, whereby the second four bar linkage system operates in conjunction with the first four bar linkage system and the resistance means to create a mechanical disadvantage to the user.

17 Claims, 13 Drawing Sheets

U.S. PATENT DOCUMENTS

| | | | |
|---|---|---|---|
| 192,338 | A | 6/1877 | Marshall |
| 393,265 | A | 11/1888 | Rice |
| 457,400 | A | 8/1891 | Dowd |
| 511,251 | A | 12/1893 | Pickles |
| 551,803 | A | 12/1895 | Whitely |
| 595,492 | A | 12/1897 | McFadden |
| 629,655 | A | 7/1899 | Bryon, Jr. |
| 664,210 | A | 12/1900 | Bryon, Jr. |
| 684,688 | A | 10/1901 | Herz |
| 685,788 | A | 11/1901 | McFadden |
| 691,538 | A | 1/1902 | Frigerio |
| 716,520 | A | 12/1902 | Cole |
| 763,475 | A | 6/1904 | Frazee et al. |
| 772,906 | A | 10/1904 | Reach |
| 776,824 | A | 12/1904 | Byron, Jr. |
| 799,270 | A | 9/1905 | Roland |
| 848,272 | A | 3/1907 | Thornley |
| 885,074 | A | 4/1908 | Nidever |
| 1,053,109 | A | 2/1913 | Reach |
| 1,205,426 | A | 11/1916 | Barnhill |
| 1,371,750 | A | 3/1921 | Fox |
| 1,547,268 | A | 7/1925 | Sotomayor |
| 1,585,748 | A | 5/1926 | Wendelken |
| 1,646,818 | A | 10/1927 | Holland |
| 1,703,104 | A | 2/1929 | Hassler |
| 1,745,435 | A | 2/1930 | Mensendieck |
| 1,867,642 | A | 7/1932 | Woods |
| 1,928,089 | A | 9/1933 | Blickman |
| 2,131,570 | A | 9/1938 | Riley |
| 2,223,309 | A | 11/1940 | Swanson |
| 2,436,987 | A | 3/1948 | Bailleaux |
| 2,632,645 | A | 3/1953 | Barkschat |
| 2,753,722 | A | 7/1956 | De Grave |
| 2,788,211 | A | 4/1957 | Ivanoff |
| 2,855,199 | A | 10/1958 | Noland et al. |
| 2,921,791 | A | 1/1960 | Berne |
| 2,944,592 | A | 7/1960 | Halter |
| 2,977,120 | A | 3/1961 | Morris |
| 3,306,611 | A | 2/1967 | Gaul |
| 3,309,084 | A | 3/1967 | Simmons |
| 3,323,366 | A | 6/1967 | DeLorme, Jr. et al. |
| 3,342,485 | A | 9/1967 | Gaul |
| 3,379,439 | A | 4/1968 | Sorenson et al. |
| 3,550,523 | A | 12/1970 | Segal |
| 3,567,219 | A | 3/1971 | Foster |
| 3,575,058 | A | 4/1971 | Kraus |
| 3,588,101 | A | 6/1971 | Jungreis |
| 3,596,907 | A | 8/1971 | Brighton et al. |
| 3,598,404 | A | 8/1971 | Bowman |
| 3,614,097 | A | 10/1971 | Blickman |
| 3,638,941 | A | 2/1972 | Kulkens |
| 3,647,209 | A | 3/1972 | La Lanne |
| 3,658,327 | A | 4/1972 | Thiede |
| 3,662,602 | A | 5/1972 | Weiss |
| 3,701,529 | A | 10/1972 | Kruthaupt |
| 3,707,285 | A | 12/1972 | Martin |
| 3,708,167 | A | 1/1973 | Potgieter |
| 3,712,613 | A | 1/1973 | Feather et al. |
| 3,734,495 | A | 5/1973 | Nist et al. |
| 3,752,473 | A | 8/1973 | La Lanne |
| 3,759,512 | A | 9/1973 | Yount et al. |
| 3,822,599 | A | 7/1974 | Brentham |
| 3,850,431 | A | 11/1974 | Winans |
| 3,856,297 | A | 12/1974 | Schnell |
| 3,858,873 | A | 1/1975 | Jones |
| 3,912,261 | A | 10/1975 | Lambert, Sr. |
| 3,970,302 | A | 7/1976 | McFee |
| 3,981,500 | A | 9/1976 | Ryan |
| 3,998,454 | A | 12/1976 | Jones |
| 4,063,727 | A | 12/1977 | Hall |
| 4,066,259 | A | 1/1978 | Brentham |
| 4,082,267 | A | 4/1978 | Flavell |
| 4,109,907 | A | 8/1978 | Zito |
| 4,111,414 | A | 9/1978 | Roberts |
| 4,114,610 | A | 9/1978 | Koch |
| 4,129,297 | A | 12/1978 | Dolan |
| 4,130,014 | A | 12/1978 | Eddens |
| 4,149,713 | A | 4/1979 | McLeod |
| 4,154,441 | A | 5/1979 | Gajda |
| 4,200,279 | A | 4/1980 | Lambert, Jr. |
| 4,204,676 | A | 5/1980 | Givens |
| 4,208,049 | A | 6/1980 | Wilson |
| D256,821 | S | 9/1980 | Weider |
| 4,229,002 | A | 10/1980 | Masters |
| 4,231,568 | A | 11/1980 | Riley et al. |
| 4,235,437 | A | 11/1980 | Ruis et al. |
| 4,240,626 | A | 12/1980 | Lambert, Jr. |
| 4,240,627 | A | 12/1980 | Brentham |
| 4,247,098 | A | 1/1981 | Brentham |
| 4,254,949 | A | 3/1981 | Brentham |
| 4,257,592 | A | 3/1981 | Jones |
| 4,290,597 | A | 9/1981 | Schleffendorf |
| 4,296,924 | A | 10/1981 | Anzaldua et al. |
| 4,328,965 | A | 5/1982 | Hatfield |
| 4,336,934 | A | 6/1982 | Hanagan et al. |
| 4,349,192 | A | 9/1982 | Lambert, Jr. et al. |
| 4,349,193 | A | 9/1982 | Lambert, Jr. et al. |
| 4,354,675 | A | 10/1982 | Barclay et al. |
| 4,354,676 | A | 10/1982 | Ariel |
| 4,357,010 | A | 11/1982 | Telle |
| 4,357,011 | A | 11/1982 | Voris |
| RE31,113 | E | 12/1982 | Coker et al. |
| 4,363,480 | A | 12/1982 | Fisher et al. |
| RE31,170 | E | 3/1983 | Mazman |
| 4,387,893 | A | 6/1983 | Baldwin |
| 4,387,894 | A | 6/1983 | Baumann |
| 4,397,462 | A | 8/1983 | Wilmarth |
| 4,398,713 | A | 8/1983 | Ellis |
| 4,402,505 | A | 9/1983 | Young |
| 4,405,128 | A | 9/1983 | McLaughlin et al. |
| 4,407,503 | A | 10/1983 | Nishizawa |
| 4,411,421 | A | 10/1983 | Hershberger |
| 4,411,424 | A | 10/1983 | Barnett |
| 4,426,077 | A | 1/1984 | Becker |
| 4,428,578 | A | 1/1984 | Kirkpatrick |
| 4,429,871 | A | 2/1984 | Flechner |
| 4,456,245 | A | 6/1984 | Baldwin |
| 4,466,613 | A | 8/1984 | Reese |
| 4,478,411 | A | 10/1984 | Baldwin |
| 4,478,413 | A | 10/1984 | Siwula |
| 4,493,485 | A | 1/1985 | Jones |
| 4,494,662 | A | 1/1985 | Clymer |
| 4,500,089 | A | 2/1985 | Jones |
| 4,502,681 | A | 3/1985 | Blomqvist |
| 4,505,475 | A | 3/1985 | Olschansky et al. |
| 4,511,137 | A | 4/1985 | Jones |
| 4,512,571 | A | 4/1985 | Hermelin |
| 4,515,363 | A | 5/1985 | Schleffendorf |
| 4,535,985 | A | 8/1985 | Mask |
| 4,536,027 | A | 8/1985 | Brennan |
| 4,540,171 | A | 9/1985 | Clark et al. |
| 4,542,899 | A | 9/1985 | Hendricks |
| 4,546,971 | A | 10/1985 | Raasoch |
| 4,549,733 | A | 10/1985 | Salyer |
| 4,555,109 | A | 11/1985 | Hartmann |
| 4,568,078 | A | 2/1986 | Weiss |
| 4,589,656 | A | 5/1986 | Baldwin |
| D284,597 | S | 7/1986 | Smith et al. |
| 4,598,908 | A | 7/1986 | Morgan |
| 4,600,196 | A | 7/1986 | Jones |
| 4,601,466 | A | 7/1986 | Lais |
| 4,602,373 | A | 7/1986 | Dorfman |
| 4,603,855 | A | 8/1986 | Sebelle |
| 4,605,389 | A | 8/1986 | Westhoff |

4,606,541 A 8/1986 Kirkpatrick
4,609,189 A 9/1986 Brasher
4,609,193 A 9/1986 Paris et al.
4,620,704 A 11/1986 Shifferaw
4,621,807 A 11/1986 Stramer
4,624,457 A 11/1986 Silberman et al.
4,627,615 A 12/1986 Nurkowski
4,629,185 A 12/1986 Amann
4,632,388 A 12/1986 Schleffendorf
4,632,390 A 12/1986 Richey
4,634,118 A 1/1987 Jensen
4,634,127 A 1/1987 Rockwell
4,635,926 A 1/1987 Minkow
4,640,508 A 2/1987 Escher
4,643,420 A 2/1987 Riley et al.
4,645,205 A 2/1987 Wolff
4,648,594 A 3/1987 Schleffendorf
4,653,750 A 3/1987 McIntyre
4,666,149 A 5/1987 Olschansky et al.
4,666,152 A 5/1987 Jones
4,684,124 A 8/1987 Escher
4,684,125 A 8/1987 Lantz
4,685,670 A 8/1987 Zinkin
4,690,402 A 9/1987 Basting
4,697,809 A 10/1987 Rockwell
4,700,944 A 10/1987 Sterba et al.
4,703,928 A 11/1987 Escher
4,709,918 A 12/1987 Grinblat
4,709,920 A 12/1987 Schnell
4,721,303 A 1/1988 Fitzpatrick
4,722,522 A 2/1988 Lundgren
4,725,056 A 2/1988 Behrl et al.
4,725,057 A 2/1988 Shifferaw
4,730,828 A 3/1988 Lane
4,730,829 A 3/1988 Carlson
4,732,381 A 3/1988 Skowronski
4,733,860 A 3/1988 Steffee
4,743,010 A 5/1988 Geraci
4,743,011 A 5/1988 Coffey
4,749,182 A 6/1988 Duggan
4,749,189 A 6/1988 Frank
4,750,736 A 6/1988 Watterson
4,753,126 A 6/1988 Sammaratano
4,756,527 A 7/1988 Ledbetter
4,763,897 A 8/1988 Yakata
4,765,613 A 8/1988 Voris
4,765,614 A 8/1988 Shute
4,768,779 A 9/1988 Oehman, Jr. et al.
4,772,015 A 9/1988 Carlson et al.
4,773,398 A 9/1988 Tatom
4,781,374 A 11/1988 Lederman
4,793,608 A 12/1988 Mahnke et al.
D299,371 S 1/1989 Tsuyama
4,795,149 A 1/1989 Pearson
4,796,881 A 1/1989 Watterson
4,804,179 A 2/1989 Murphy et al.
4,809,972 A 3/1989 Rasmussen et al.
4,809,973 A 3/1989 Johns
4,813,667 A 3/1989 Watterson
4,815,746 A 3/1989 Ward, Jr.
4,822,032 A 4/1989 Whitmore et al.
4,822,036 A 4/1989 Dang
4,824,104 A * 4/1989 Bloch ..... 482/6
4,826,153 A 5/1989 Schalip
4,826,157 A 5/1989 Fitzpatrick
4,834,365 A 5/1989 Jones
4,834,367 A 5/1989 Salyer et al.
4,836,536 A 6/1989 Jones
4,836,537 A 6/1989 Moreno
4,838,548 A 6/1989 Maag
4,840,373 A 6/1989 Maag
4,842,268 A 6/1989 Jenkins
4,842,271 A 6/1989 Vinciguerra
4,842,272 A 6/1989 Jennings
4,844,456 A 7/1989 Habing et al.
4,846,458 A 7/1989 Potts
4,848,741 A 7/1989 Hermanson
4,858,915 A 8/1989 Szabo
4,858,917 A 8/1989 Montgomery
4,861,025 A 8/1989 Rockwell
4,863,161 A 9/1989 Telle
4,863,163 A 9/1989 Wehrell
4,869,497 A 9/1989 Stewart et al.
4,872,668 A 10/1989 McGillis et al.
4,872,670 A 10/1989 Nichols
4,878,397 A 11/1989 Lennon
4,878,662 A 11/1989 Chern
4,878,663 A 11/1989 Luquette
4,883,270 A 11/1989 Maag
4,889,336 A 12/1989 Schneiderman
4,890,830 A 1/1990 Kern
D306,050 S 2/1990 Brentham
4,898,381 A 2/1990 Gordon
4,900,018 A 2/1990 Ish, III et al.
4,902,007 A 2/1990 Ferrari
4,902,009 A 2/1990 Jones
4,907,798 A 3/1990 Burchatz
4,911,435 A 3/1990 Johns
4,911,438 A 3/1990 Van Straaten
4,913,423 A 4/1990 Farran et al.
D307,782 S 5/1990 Birrell et al.
4,921,242 A 5/1990 Watterson
4,930,768 A 6/1990 Lapcevic
4,944,511 A 7/1990 Francis
4,949,951 A 8/1990 Deola
4,961,428 A 10/1990 Nikias et al.
4,974,838 A 12/1990 Sollenberger
4,979,737 A 12/1990 Kock
4,982,955 A 1/1991 Heasley
4,986,538 A 1/1991 Ish, III
4,988,095 A 1/1991 Ferrari
4,993,666 A 2/1991 Baymak et al.
5,000,446 A 3/1991 Sarno
5,002,271 A 3/1991 Gonzales
5,011,139 A 4/1991 Towley
D317,032 S 5/1991 Eckler
5,018,725 A 5/1991 Cook
5,020,794 A 6/1991 Englehardt et al.
D317,959 S 7/1991 Francis
5,029,850 A 7/1991 van Straaten
5,037,089 A 8/1991 Spagnuolo et al.
5,039,089 A 8/1991 Lapcevic
5,039,091 A 8/1991 Johnson
5,042,798 A 8/1991 Sawicky
5,042,799 A 8/1991 Stanley
5,042,801 A 8/1991 Sterba et al.
5,044,629 A 9/1991 Ryan et al.
5,044,631 A 9/1991 Jones
5,044,632 A 9/1991 Jones
5,050,873 A 9/1991 Jones
D321,025 S 10/1991 Jones
D321,026 S 10/1991 Jones
D321,027 S 10/1991 Jones
D321,028 S 10/1991 Jones
5,056,779 A 10/1991 Webb
5,060,938 A 10/1991 Hawley, Jr.
5,060,939 A 10/1991 Oswald et al.
D321,387 S 11/1991 Jones
D321,389 S 11/1991 Jones
D321,390 S 11/1991 Jones
D321,391 S 11/1991 Jones
5,062,632 A 11/1991 Dalebout et al.
5,062,633 A 11/1991 Engel et al.
5,064,191 A 11/1991 Johnson
5,066,003 A 11/1991 Jones
5,066,004 A 11/1991 Jones 5,069,447 A 12/1991 Snyderman et al.
5,076,576 A 12/1991 Johnston
5,076,577 A 12/1991 Houston
5,076,578 A 12/1991 Askonen
5,076,579 A 12/1991 Rickey
5,080,349 A 1/1992 Vittone
5,080,351 A 1/1992 Rockwell
5,085,430 A 2/1992 Habing
5,089,960 A 2/1992 Sweeney, Jr.
5,090,694 A 2/1992 Pauls et al.
D324,710 S 3/1992 Habing
5,094,124 A 3/1992 Stonehouse
5,094,449 A 3/1992 Stearns
5,094,450 A 3/1992 Stearns
5,100,131 A 3/1992 Fong
5,102,121 A 4/1992 Solow
5,102,122 A 4/1992 Piane, Jr. et al.
5,104,121 A 4/1992 Webb
5,106,080 A 4/1992 Jones
5,106,081 A 4/1992 Webb
5,106,083 A 4/1992 Hall
5,108,095 A 4/1992 Nichols
5,116,297 A 5/1992 Stonecipher
5,120,289 A 6/1992 Yu
5,122,106 A 6/1992 Atwood et al.
5,123,886 A 6/1992 Cook
5,125,881 A 6/1992 Jones
5,125,882 A 6/1992 La Mothe et al.
D328,320 S 7/1992 Hliang
5,135,216 A 8/1992 Bingham et al.
5,135,449 A 8/1992 Jones
5,135,453 A 8/1992 Sollenberger
5,135,456 A 8/1992 Jones
5,135,458 A 8/1992 Huang
5,135,459 A 8/1992 Perry, Jr.
5,145,479 A 9/1992 Olschansky et al.
5,147,265 A 9/1992 Pauls et al.
5,171,198 A 12/1992 Jones
5,180,354 A 1/1993 Jones
5,181,896 A 1/1993 Jones
D334,042 S 3/1993 Wang
5,190,513 A 3/1993 Habing et al.
5,195,937 A 3/1993 Engel et al.
5,199,935 A 4/1993 Gibson et al.
5,203,755 A 4/1993 Kaiser
5,205,802 A 4/1993 Swisher
5,205,804 A 4/1993 Hall
D335,511 S 5/1993 Engel et al.
5,209,461 A 5/1993 Whightsil, Sr.
5,211,614 A 5/1993 Henes
D336,498 S 6/1993 Engel et al.
5,217,487 A 6/1993 Engel et al.
5,221,244 A 6/1993 Doss
5,221,245 A 6/1993 Yeh
D337,361 S 7/1993 Engel et al.
D337,666 S 7/1993 Peterson et al.
5,226,867 A 7/1993 Beal
5,230,680 A 7/1993 Wu
5,236,406 A 8/1993 Webber
5,242,344 A 9/1993 Hundley
5,242,347 A 9/1993 Keeton
5,244,444 A 9/1993 Wostry
5,244,446 A 9/1993 Engel et al.
5,256,126 A 10/1993 Grotstein
D341,176 S 11/1993 Habing et al.
5,263,914 A 11/1993 Simonson et al.
5,263,915 A 11/1993 Habing
5,265,589 A 11/1993 Wang
5,267,930 A 12/1993 Henes
5,273,504 A 12/1993 Jones
5,273,505 A 12/1993 Jones
5,273,509 A 12/1993 Vittone
5,277,681 A 1/1994 Holt
5,282,776 A 2/1994 Dalebout
RE34,572 E 3/1994 Johnson et al.
5,290,214 A 3/1994 Chen
5,295,931 A 3/1994 Dreibelbis et al.
RE34,577 E 4/1994 Habing et al.
5,299,992 A 4/1994 Wilkinson
5,300,003 A 4/1994 Hull
5,302,161 A 4/1994 Loubert et al.
5,304,107 A 4/1994 Jones
5,306,221 A 4/1994 Itaru
D347,251 S 5/1994 Dreibelbis et al.
5,308,303 A 5/1994 Rawls et al.
5,308,304 A 5/1994 Habing
5,310,392 A 5/1994 Lo
5,312,313 A 5/1994 Holmes et al.
5,312,315 A 5/1994 Mortensen et al.
5,316,528 A 5/1994 Ziparo
5,316,534 A 5/1994 Dalebout et al.
5,320,592 A 6/1994 Olschansky et al.
5,322,489 A 6/1994 Webb et al.
5,324,246 A 6/1994 Wang
5,328,428 A 7/1994 Huang
5,330,405 A 7/1994 Habing et al.
5,330,408 A 7/1994 Westmoreland, Jr.
5,334,113 A 8/1994 Roepke
5,336,140 A 8/1994 LeBlond
5,336,148 A 8/1994 Ish, III
5,342,270 A 8/1994 Jones
5,344,374 A 9/1994 Telle
5,346,447 A 9/1994 Stearns
5,348,524 A 9/1994 Grant
5,354,248 A 10/1994 Rawls et al.
5,354,252 A 10/1994 Habing
5,356,360 A 10/1994 Johns
5,362,290 A 11/1994 Huang
5,366,426 A 11/1994 Glavin
5,366,432 A * 11/1994 Habing et al. ..... 482/138
5,374,229 A 12/1994 Sencil
5,378,216 A 1/1995 Ish, III et al.
5,380,258 A 1/1995 Hawley, Jr.
5,382,212 A 1/1995 Davenport et al.
5,387,170 A 2/1995 Rawls et al.
5,395,295 A 3/1995 Ish, III
5,399,133 A 3/1995 Haber et al.
5,403,257 A 4/1995 Lehtonen
5,409,435 A 4/1995 Daniels
D358,183 S 5/1995 Habing et al.
D358,625 S 5/1995 Enriquez, Jr.
5,413,546 A 5/1995 Basile
5,417,633 A 5/1995 Habing
5,417,634 A 5/1995 Habing
D359,326 S 6/1995 Deola
5,421,796 A 6/1995 Jones et al.
5,429,569 A 7/1995 Gunnari et al.
5,431,617 A 7/1995 Rattray, Jr.
5,433,680 A 7/1995 Knudsen
5,435,798 A 7/1995 Habing et al.
5,435,799 A 7/1995 Lundin
5,437,589 A 8/1995 Habing
5,441,470 A 8/1995 Chen
5,456,644 A 10/1995 Hecox et al.
5,466,204 A 11/1995 Nearing
5,468,202 A 11/1995 Habing
5,468,205 A 11/1995 McFall et al.
5,470,299 A 11/1995 Yeh
5,484,365 A * 1/1996 Jones et al. ..... 482/97
5,486,150 A 1/1996 Randolph
5,487,714 A 1/1996 Ferrari
5,492,386 A 2/1996 Callum
5,499,959 A 3/1996 Holmes et al.
D368,501 S 4/1996 Woodruff
5,511,740 A 4/1996 Loubert et al.
D370,040 S 5/1996 Habing et al.

5,518,477 A 5/1996 Simonson
D370,949 S 6/1996 Furner
D371,176 S 6/1996 Furner
5,527,243 A 6/1996 Chen
5,527,245 A 6/1996 Dalebout
5,533,953 A 7/1996 Lui et al.
5,542,895 A 8/1996 Colbo, Jr.
5,549,530 A 8/1996 Fulks
5,549,533 A 8/1996 Olson et al.
5,554,084 A 9/1996 Jones
5,554,085 A 9/1996 Dalebout
5,554,086 A 9/1996 Habing et al.
5,554,089 A 9/1996 Jones
5,554,090 A 9/1996 Jones
5,562,577 A 10/1996 Nichols, Sr. et al.
5,580,337 A 12/1996 Habing et al.
5,580,340 A 12/1996 Yu
5,580,341 A 12/1996 Simonson
5,582,564 A 12/1996 Nichols, Sr. et al.
5,586,962 A 12/1996 Hallmark
5,588,942 A 12/1996 Dillard
5,591,105 A 1/1997 Dalebout et al.
5,597,257 A 1/1997 Habing
5,599,256 A 2/1997 Hughes, Jr.
5,601,518 A 2/1997 Weintraub
RE35,470 E 3/1997 Jones
5,616,107 A * 4/1997 Simonson ..... 482/97
5,616,110 A 4/1997 Nascimento
5,616,111 A 4/1997 Randolph
5,624,353 A 4/1997 Naidus
5,624,362 A 4/1997 Wilson
5,626,548 A 5/1997 Coyle
5,628,715 A 5/1997 Simonson
D380,024 S 6/1997 Novak et al.
5,637,059 A 6/1997 Dalebout
5,643,151 A 7/1997 Naimo
5,655,997 A 8/1997 Greenberg et al.
5,665,036 A 9/1997 Hsieh
5,667,464 A 9/1997 Simonson
5,669,861 A 9/1997 Toups
5,669,865 A 9/1997 Gordon
5,674,167 A 10/1997 Piaget et al.
5,681,079 A 10/1997 Robinson
5,692,997 A 12/1997 Stearns
5,709,633 A 1/1998 Sokol
5,713,823 A 2/1998 Walendzak et al.
5,716,308 A 2/1998 Lee
5,718,654 A 2/1998 Kennedy
5,722,921 A 3/1998 Simonson
5,722,922 A 3/1998 Watterson et al.
5,725,459 A 3/1998 Rexach
5,733,229 A 3/1998 Dalebout et al.
5,733,233 A 3/1998 Webber
5,738,616 A 4/1998 Robertson
5,755,645 A 5/1998 Miller et al.
5,762,584 A 6/1998 Daniels
5,769,757 A 6/1998 Fulks
5,769,766 A 6/1998 Huang
5,776,040 A 7/1998 Webb et al.
5,788,615 A 8/1998 Jones
5,800,321 A 9/1998 Webber
5,803,882 A 9/1998 Habing et al.
5,807,219 A 9/1998 Webber et al.
5,810,698 A 9/1998 Hullett et al.
5,810,701 A 9/1998 Ellis et al.
5,813,951 A 9/1998 Einsig
5,820,529 A 10/1998 Weintraub
5,827,157 A 10/1998 Lee
5,836,858 A 11/1998 Sharff
5,839,997 A 11/1998 Roth et al.
5,860,894 A 1/1999 Dalebout
5,876,313 A 3/1999 Krull
5,885,193 A 3/1999 Habing et al.
5,888,179 A 3/1999 Singhal
5,897,467 A 4/1999 Habing et al.
5,904,638 A 5/1999 Habing et al.
5,906,566 A 5/1999 Whitcomb
5,921,897 A 7/1999 Stevens
5,921,902 A 7/1999 Carpenter
5,931,767 A 8/1999 Morales
5,938,551 A 8/1999 Warner
5,944,641 A 8/1999 Habing
D413,948 S 9/1999 Dalebout
5,951,448 A 9/1999 Bolland
5,961,427 A 10/1999 Habing et al.
5,961,428 A 10/1999 Webber
5,964,684 A 10/1999 Sokol
5,967,954 A 10/1999 Habing
5,971,895 A 10/1999 Habing
5,989,165 A 11/1999 Giannelli et al.
5,993,356 A 11/1999 Houston et al.
6,004,247 A 12/1999 Webber
6,004,248 A 12/1999 Price
6,022,299 A 2/2000 Stewart
6,027,429 A 2/2000 Daniels
6,056,678 A 5/2000 Giannelli et al.
6,059,701 A 5/2000 George et al.
6,074,328 A 6/2000 Johnson
6,090,020 A 7/2000 Webber
6,099,440 A 8/2000 Schurter et al.
6,117,055 A 9/2000 Boland
6,120,416 A 9/2000 Walker
6,120,421 A 9/2000 Kuo
D431,615 S 10/2000 Webber et al.
6,126,580 A 10/2000 Francis et al.
6,186,927 B1 2/2001 Krull
6,206,812 B1 3/2001 Nizamuddin
6,217,493 B1 4/2001 Spletzer
6,220,993 B1 * 4/2001 Sencil ..... 482/97
6,224,514 B1 5/2001 Price
6,238,323 B1 5/2001 Simonson
6,251,052 B1 6/2001 Simonson
6,257,997 B1 7/2001 Doble et al.
6,258,016 B1 7/2001 Kuo
6,261,022 B1 7/2001 Dalebout et al.
6,264,586 B1 7/2001 Webber
6,264,588 B1 7/2001 Ellis
6,287,241 B1 9/2001 Ellis
6,296,596 B1 * 10/2001 Alessandri et al. ..... 482/100
6,319,178 B1 11/2001 Webber
D455,803 S 4/2002 Webber
6,364,815 B1 4/2002 Lapcevic
6,371,896 B1 4/2002 Kettler
6,394,937 B1 5/2002 Voris
6,402,666 B2 6/2002 Krull
6,409,631 B1 6/2002 Alessandri
6,422,979 B1 7/2002 Krull
6,440,044 B1 8/2002 Francis et al.
6,443,877 B1 9/2002 Hoecht et al.
6,447,430 B1 9/2002 Webb et al.
6,458,061 B2 10/2002 Simonson
6,471,624 B1 10/2002 Voris
6,482,139 B1 11/2002 Haag
6,488,612 B2 12/2002 Sechrest et al.
6,491,609 B2 12/2002 Webber
6,491,610 B1 12/2002 Henn
6,500,106 B1 12/2002 Fulks
6,517,468 B1 2/2003 Lapcevic
6,551,226 B1 4/2003 Webber et al.
6,561,960 B2 5/2003 Webber
6,575,881 B2 6/2003 Lapcevic
6,579,213 B1 6/2003 Webber et al.
6,585,626 B2 7/2003 McBride
6,592,498 B1 7/2003 Trainor
6,595,905 B2 7/2003 McBride
6,605,022 B2 8/2003 Webber

| | | | | |
|---|---|---|---|---|
| 6,605,024 | B2 | 8/2003 | Stearns | |
| 6,626,805 | B1 | 9/2003 | Lightbody | |
| 6,652,426 | B2 | 11/2003 | Carter et al. | |
| 6,652,429 | B2 | 11/2003 | Bushnell | |
| 6,669,606 | B2 | 12/2003 | Krull | |
| 6,669,609 | B2 | 12/2003 | Gerschefske et al. | |
| 6,685,607 | B1 | 2/2004 | Olson | |
| 6,743,158 | B2 | 6/2004 | Giannelli et al. | |
| 6,746,378 | B2 | 6/2004 | Morris et al. | |
| 6,746,385 | B1 | 6/2004 | Habing | |
| 6,770,017 | B1 * | 8/2004 | Leipheimer | 482/142 |
| 6,817,968 | B2 | 11/2004 | Galbraith et al. | |
| 6,830,542 | B2 | 12/2004 | Ball et al. | |
| 6,910,994 | B2 | 6/2005 | Mitchell et al. | |
| 6,913,565 | B2 | 7/2005 | Mitchell et al. | |
| 7,070,545 | B2 | 7/2006 | Lull et al. | |
| 7,220,221 | B2 * | 5/2007 | Mosimann et al. | 482/100 |
| 2002/0025890 | A1 | 2/2002 | Keiser | |
| 2002/0035017 | A1 | 3/2002 | Pertegaz-Esteban | |
| 2002/0077230 | A1 | 6/2002 | Lull et al. | |
| 2002/0198087 | A1 | 12/2002 | Mitchell et al. | |
| 2002/0198088 | A1 | 12/2002 | Vuurmans et al. | |
| 2003/0017918 | A1 | 1/2003 | Webb et al. | |
| 2003/0022767 | A1 | 1/2003 | Webber | |
| 2003/0032524 | A1 | 2/2003 | Lamar et al. | |
| 2003/0032531 | A1 | 2/2003 | Simonson | |
| 2003/0045406 | A1 | 3/2003 | Stone | |
| 2003/0092540 | A1 | 5/2003 | Gillen | |
| 2003/0092541 | A1 | 5/2003 | Giannelli | |
| 2003/0092543 | A1 | 5/2003 | Giannelli | |
| 2003/0096681 | A1 | 5/2003 | Myers et al. | |
| 2003/0100413 | A1 | 5/2003 | Huang | |
| 2003/0114281 | A1 | 6/2003 | Mackert et al. | |
| 2003/0158018 | A1 | 8/2003 | Giannelli et al. | |
| 2003/0176261 | A1 | 9/2003 | Simonson et al. | |
| 2003/0232707 | A1 | 12/2003 | Dalebout et al. | |
| 2004/0002409 | A1 | 1/2004 | Webb et al. | |
| 2004/0009856 | A1 | 1/2004 | Hammer | |
| 2004/0009857 | A1 | 1/2004 | Webb et al. | |
| 2004/0023760 | A1 | 2/2004 | Cockrill, Jr. et al. | |
| 2004/0063551 | A1 | 4/2004 | Lightbody | |
| 2004/0082444 | A1 | 4/2004 | Golesh | |
| 2004/0091307 | A1 | 5/2004 | James | |
| 2004/0176223 | A1 | 9/2004 | Morris et al. | |
| 2004/0209748 | A1 | 10/2004 | Haneckow | |
| 2004/0229735 | A1 | 11/2004 | Morris et al. | |
| 2005/0124470 | A1 | 6/2005 | Schopf | |
| 2007/0037673 | A1 | 2/2007 | Giannelli et al. | |

FOREIGN PATENT DOCUMENTS

| | | | |
|---|---|---|---|
| CA | 1 184 577 | | 3/1985 |
| CA | 1 199 946 | | 1/1986 |
| CA | 1 203 822 | | 4/1986 |
| CA | 1 256 136 | | 6/1989 |
| CH | 457230 | | 7/1968 |
| DE | 605 957 | | 11/1934 |
| DE | 2346105 | A1 | 3/1975 |
| DE | 3 300 073 | A1 | 7/1984 |
| DE | G 92 13 188.3 | | 11/1992 |
| DE | 43 20 887 | A1 | 6/1994 |
| DE | 43 20 887 | C2 | 6/1994 |
| DE | G 94 11 573.7 | | 9/1994 |
| DE | 198 01 672 | A1 | 11/1998 |
| EP | 121902 | A1 | 10/1984 |
| EP | 177017 | A2 | 4/1986 |
| EP | 177643 | A1 | 4/1986 |
| FR | 824654 | | 2/1938 |
| FR | 1335110 | | 7/1963 |
| FR | 2612406 | A1 | 9/1988 |
| FR | 2613237 | A1 | 10/1988 |
| FR | 2627090 | A1 | 8/1989 |
| GB | 325435 | | 2/1930 |
| GB | 466901 | | 6/1937 |
| GB | 1 151 656 | | 5/1969 |
| GB | 2 223 686 | A | 4/1990 |
| GB | 2 232 089 | A | 12/1990 |
| IT | 604340 | | 5/1960 |
| NL | 8800024 | | 8/1989 |
| SU | 1253654 | | 8/1986 |
| SU | 1258447 | A1 | 9/1986 |
| SU | 1367987 | A1 | 1/1988 |
| SU | 1 725 744 | A3 | 4/1992 |
| SU | 1743620 | | 6/1992 |
| TW | 210014 | | 7/1993 |
| TW | 317755 | | 10/1997 |
| TW | 331154 | | 5/1998 |
| TW | 364363 | | 7/1999 |
| WO | WO 86/06644 | A1 | 11/1986 |
| WO | WO 90/09212 | A1 | 8/1990 |
| WO | WO 92/18202 | A1 | 10/1992 |
| WO | WO 94/14505 | A1 | 7/1994 |
| WO | WO 96/26765 | A1 | 9/1996 |
| WO | WO 01/19462 | A1 | 3/2001 |
| WO | WO 01/66195 | A2 | 9/2001 |

OTHER PUBLICATIONS

BFit® University Presents Bally "Total Fitness PowerPump the Official Barbell Workout," Training Manual (1998).

The Body Bar, "A Total Body Conditioning Bar," brochure, The Step Company (1995).

Body Masters MD 504 Pec Contractor & Rear Deltoid Machine, brochure (1994).

Body Pump™, "Aerobic Market 'Pumped Up' about New Zealand's Body Pump ™ Program," Press Release, Les Mills International/The Step Company (date unknown).

Body Pump™, "Anybody and Everybody Wants to . . . Become Some Body" Brochure, A Product of the Step Company and Developed by Les Mills Aerobics (date unknown).

Body Pump™, "Become Some Body!", Press Release, Les Mills International/The Step (date unknown).

Body Pump™, Instructor Manual Version II ©, Les Mills International/The Step Company (1998).

Body Pump™, "Taking a Good Idea One Step Further," Press Release, The Step Company/Les Mills International (date unknown).

Body Pump™, Trainer Manual Version II ©, Les Mills International/The Step Company (1998).

Body Pump Training Brochure, the Step Company/Les Mills International (date unknown).

Bowflex advertisement flyer and order form "Special Offer! Order in 30 days and Receive an Extra 100lbs of Power Rods Free!", 20 pages (1992).

"Bowflex Fitness", Bowflex, Inc., catalog, 8 pages (1998).

"Cross Bow by Weider How Does the Crossbow Stack up Against the Competition", ICON Health and Fitness located at http://www.iconfitness.com/crossbow/cb_vs_bf.html, 2 pages (retrieved Oct. 22, 2002).

Cybex International, Inc., Commercial Strength Systems brochure, 4535 Arm Curl, 5255 Rear Delt, 5281 Arm Curl, pp. 9 and 36 (Apr. 2000).

Cybex International, Inc., Cybex Eagle Premier Strength brochure, 11080 Arm Extension, p. 8 (May 2002).

Cybex World, "New Products Prove Passion for Human Performance," vol. 10, Issue 2 (Jul. 2000).

"HD 1800 Inner/Outer Thigh," Hoist Fitness Systems, Inc., located at http://www.hoistfitness.com, 3 pages (retrieved Apr. 30, 2004).

Introducing . . . Nautilus for Women by Dan Baldwin, National Fitness Trade Journal, pp. 44-47 (date unknown).

Johnny G Spinning © Instructor Manual, (Copyright 1995).

Keiser® Power Pacer, Instructor Training Manual©, by Keiser Corporation (1997, 1998).

"MG-32 Ski Machine" and "MG-034 Simple Body Stretcher", Modas Shing Co., Ltd., 1 page (undated).

*Maximize Your Performance*, "the ultimate workout" Versatrainer by Pro-Max, 1 page (undated).
Nautilus catalog, 92 pages (undated).
Nautilus® Fitness Accessories 2001 brochure, 15 pages (2001).
Nautilus® Free Weight Equipment 2001 brochure, 11 pages (2001).
Nautilus® Home Gyms 2001 brochure, 11 pages (2001).
"Nautilus Next Generation Product Line", Nautilus catalog, 8 pages, (undated).
Nautilus, The Next Generation catalog, 49 pages (undated).
Nautilus NS-4000 picture, one page (undated).
Nautilus Super Smooth Technology, "Equipment Comparison", undated brochure, one page (undated).
"Nautilus Time Machine," Nautilus Inc., cover page of product brochure and one page therefrom, 2 pages (undated).
Nebula Fitness Equipment by Proto Weld, Inc., 4005—Lever Row Swivel Adjustments, brochure (received by USPTO Sep. 1995).
New Fitness Trend Guarantees Company's Success, Press Release, The Step® Company (undated).
"Odyssey 5" Home Gym, TuffStuff, cover page of product brochure and three images therefrom, 2 pages (2001).
PowerLine by TuffStuff, Task Industries Inc., PL-221, Leg Curl/Extension Combo, undated brochure.
Schwinn Cycling & Fitness Inc., "Airdyne® Backdraft™ Recumbent Bike" (1996).
Schwinn Cycling & Fitness Inc., "Airdyne® Windsprint™ Interval Bike," (1996).
Schwinn® Fitness, "Harness the Force of Nature and You Possess the Strength of Confidence" brochure 30 pages (1996-1997).
Schwinn Iron Classic Strength Training System by Bowflex® Owner's Manual, 55 pages (1993).
The Slide Home Trainer, "The Professional, Portable Home Slide," brochure, The Step Company (1995).
The Slide Trainer The Professional Slideboard, "The Professional Slideboard," brochure, The Step Company (1995).
Soloflex catalog, p. 23 (1981).
"Stamina LT-2000 Band Flex Gym", Stamina Products, Inc., located at Egghead.com, 3 pages (at least as early as Mar. 9, 2001).
"The Standing Firm System", located at http://www.standing-pilates.com, 6 pages (retrieved Sept. 29, 2004).
The Step® Company Club Price List, Les Mills International/The Step Company (May 1998).
The Step® Home Trainer, "The Intermediate Home Step System," brochure, The Step Company (1995).
The Step® Home Workout System, "The Compact Professional Step Trainer," brochure, The Step Company (1995).
The Step, "The Original Health Club Step," brochure, The Step Company (1995).
The Step, "The Professional Club Model," brochure, The Step Company (1995).
The Studio Step, "The Compact Club Model," brochure, The Step Company (1995).
TuffStuff, TUB-49 Upper Body Machine, brochure (received by USPTO Mar. 1998).
Universal 1981-82 catalog, p. 12 (Jun. 1, 1981).
"V5 Multi Gym," Hoist Fitness Systems, Inc., located at http://www.hoistfitness.com, 3 pages (retrieved Apr. 30, 2004).
Little, John, Chest Essentials, Muscle & Fitness, pp. 138-144 (Sep. 1995).
Preliminary Amendment, U.S. Appl. No. 09/848,105, dated Dec. 12, 2001, 18 pages.
Office Action and PTO-892, U.S. Appl. No. 09/848,105, mailed Aug. 12, 2003, 10 pages.
Amendment, U.S. Appl. No. 09/848,105, dated Jan. 20, 2004, 13 pages.
Notice of Allowance, Notice of Allowability, Examiner's Amendment, and PTO-892, U.S. Appl. No. 09/848,105, mailed May 18, 2004, 6 pages.
Notice of Allowance and Notice of Allowability, U.S. Appl. No. 09/848,105, mailed Dec. 1, 2004, 2 pages.
Office Action and PTO-892, U.S. Appl. No. 09/848,105, mailed Apr. 7, 2006, 11 pages.
Amendment and Response, U.S. Appl. No. 09/848,105, dated Sep. 7, 2006, 7 pages.
Notice of Allowance, Notice of Allowability, and Examiner's Amendment, U.S. Appl. No. 09/848,105, mailed Sep. 13, 2006, 3 pages.
Notice of Allowance, Notice of Allowability, Examiner's Amendment, and PTO-892, U.S. Appl. No. 09/848,105, mailed Dec. 29, 2006, 5 pages.
Office Action and PTO-892, U.S. Appl. No. 10/211,409, mailed Dec. 13, 2004,7 pages.
Amendment and Response to Office Action, U.S. Appl. No. 10/211,409, dated Jun. 13, 2005, 8 pages.
Notice of Allowance, Notice of Allowability, and Detailed Action, U.S. Appl. No. 10/211,409, mailed Aug. 23, 2005, 7 pages.
Notice of Allowance, Notice of Allowability, and Detailed Action, U.S. Appl. No. 10/211,409, mailed Feb. 10, 2006,4 pages.
Office Action and PTO-892, U.S. Appl. No. 07/646,805, mailed Jun. 26, 1991, 6 pages.
Amendment, U.S. Appl. No. 07/646,805, dated Oct. 25, 1991, 3 pages.
Notice of Allowance, Notice of Allowability, and Interview Summary, U.S. Appl. No. 07/646,805, mailed Nov. 20, 1991, 5 pages.

* cited by examiner

LEG PRESS AND ABDOMINAL CRUNCH EXERCISE MACHINE

CROSS REFERENCE TO RELATED APPLICATION

This application is a continuation of U.S. patent application Ser. No. 10/211,409 filed on Aug. 1, 2002, and entitled "Leg Press and Abdominal Crunch Exercise Machine," now U.S. Pat. No. 7,070,545, which application is a continuation-in-part of U.S. patent application Ser. No. 10/186,433 filed Jul. 1, 2002, and entitled "Leg Curl/Leg Extension Weight Training Machine," now U.S. Pat. No. 7,150,702, and which is also a continuation-in-part of U.S. patent application Ser. No. 10/192,330 filed Jul. 10, 2002, now U.S. Pat. No. 7,004,890, and entitled "Leg Press Weight Training Machine," all of which are hereby incorporated by reference as if fully disclosed herein.

BACKGROUND OF THE INVENTION

1. Field of the Invention

This invention relates to exercise equipment and machines for home commercial use.

2. Description of the Related Art

For example, commonly owned U.S. Pat. No. 5,106,081 to Webb discloses a leg press machine that incorporates a four bar linkage configuration for changing the angle of inclination of the foot plate to maintain a normal orientation to the lower legs of a user throughout the movement of the leg press exercise. While providing an instantaneous axis of rotation for the foot plate, the linkage between the four bar linkage of the leg press and the weight stack used as a resistance force, although quite functional, is also quite cumbersome. The Webb machine includes, inter alia, a shaft between a sprocket on one end as part of the weight stack and variable radius cam on the other end connected to the four bar linkage.

Further, the force curve of the exercise machine disclosed in Webb is fairly constant (as shown by the before and after positions of the four bar linkage and the attached chain and sprocket) throughout the exercise motion. A flat force curve does not provide the most effective exercise results for a user because of the elementary principles of momentum—a body in motion tends to stay in motion, while a body at rest tends to stay at rest. Therefore, it may be more difficult for a user to start the exercise and put the mass (resistance force) in motion. However, once in motion, the exercise will be easier for the user because of the momentum already imparted to the user. Thus, if a leg press exercise machine were designed with an increasing force curve through the pressing motion of the exercise, a user would get a better workout. The exercise would be easier to start, but the resistance would increase throughout the press motion, thereby making the user's muscles work harder than if the force curve were flat.

SUMMARY OF THE INVENTION

One embodiment of the invention disclosed is an exercise machine, which in one aspect is composed of a frame, a first four bar linkage system, a second four bar linkage system, and a means for transferring an incident force from the legs of a user. The first four bar linkage system is operably mounted on the frame and operably connects the transferring means to the frame and allows for back and forth movement of the transferring means along a path of travel about an instantaneously changing axis of rotation. The instantaneously changing axis of rotation changes the angle of inclination of the transferring means to maintain the transferring means in a position normal to the length of the lower legs of the user during a corresponding leg extension movement of the user. The second four bar linkage system operably engages the first four bar linkage system. Either or both of the first four bar linkage system and the second four bar linkage system are operably connected to a resistance means, whereby the second four bar linkage system operates in conjunction with the first four bar linkage system and the resistance means to create a mechanical disadvantage to the user.

The combination of the first four bar linkage system and the second four bar linkage system can be viewed as a force conditioning device. In fact, a force conditioning device as disclosed herein may be a system employing more than four bars operably connected together to provide a mechanical advantage to a first force acting on the device in opposition to a second force acting on the device.

In another embodiment of the invention, the exercise machine is composed of a frame supporting a first four bar linkage system and a second four bar linkage system. The first four bar linkage system is composed of a first substantially vertical member and a second substantially vertical member spaced apart from the first vertical member. The first member and second member are operably mounted at their lower ends to a portion of the frame in a first spaced relation to each other. The second four bar linkage system operably engages the first four bar linkage system and is actually composed of a portion of the first four bar linkage system plus additional components. The additional components of the second four bar linkage system are a third member operably engaged with at least one of the first member, the second member, the support member, and the frame; and a fourth member operably engaged with the third member and at least one of the first member, the second member, the support member, and the frame. A resistance force is operatively connected to at least one of the first four bar linkage system and the second four bar linkage system, for example, by a cable and pulley system connected to a weight stack. A support member is mounted to a foot plate for engaging the feet of a user and for receiving an incident force from the legs of the user. The support member is further operably mounted substantially transverse to each of the first member and the second member at their upper ends in a second spaced relation to each other. The second spaced relation is a lesser distance than the first spaced relation. The first four bar linkage system allows for back and forth movement of the foot plate along a path of travel about an instantaneously changing axis of rotation and for changing the angle of inclination of the foot plate to maintain the foot plate in a position normal to the length of the lower legs of the user during a corresponding leg extension movement of the user. The second four bar linkage system continually increases the incident force required of the user to exert on the foot plate during a leg extension movement to counteract a constant force exerted by the resistance means.

The exercise machine may further be composed of a first arm member connected to the frame and a second arm member pivotally mounted to the first arm member. A handlebar is operably connected to the second arm member. The handlebar is also operably connected to a resistance force, for example, by a cable and pulley system to a weight stack. In one embodiment, a single cable is operably connects the weight stack or other resistance force to both the handle and at least one of the first four bar linkage system and the second four bar linkage system The handlebar is generally positioned, through its connection between the second arm to the first arm, above the head of the user for grasping by the hands of the user. The handlebar is movable along an arcuate path together with the user while the user performs an abdominal crunch exercise. The handlebar resists a pulling force exerted by the user when the user performs an abdominal crunch exercise while grasping the handlebar, because the handlebar is operated on by the constant force of the resistance means in opposition to the pulling force of the user. When the handlebar is in a rest position, a pivot point between the first arm member and the second arm member is located in a first plane spaced apart from and in front of a second plane encompassing a first mounting point where the first arm member connects to the frame and a second mounting point where the handlebar connects to the second arm member.

Other features, utilities and advantages of various embodiments of the invention will be apparent from the following more particular description of embodiments of the invention as illustrated in the accompanying drawings and defined in the appended claims.

DETAILED DESCRIPTION OF THE INVENTION

Figure 1:
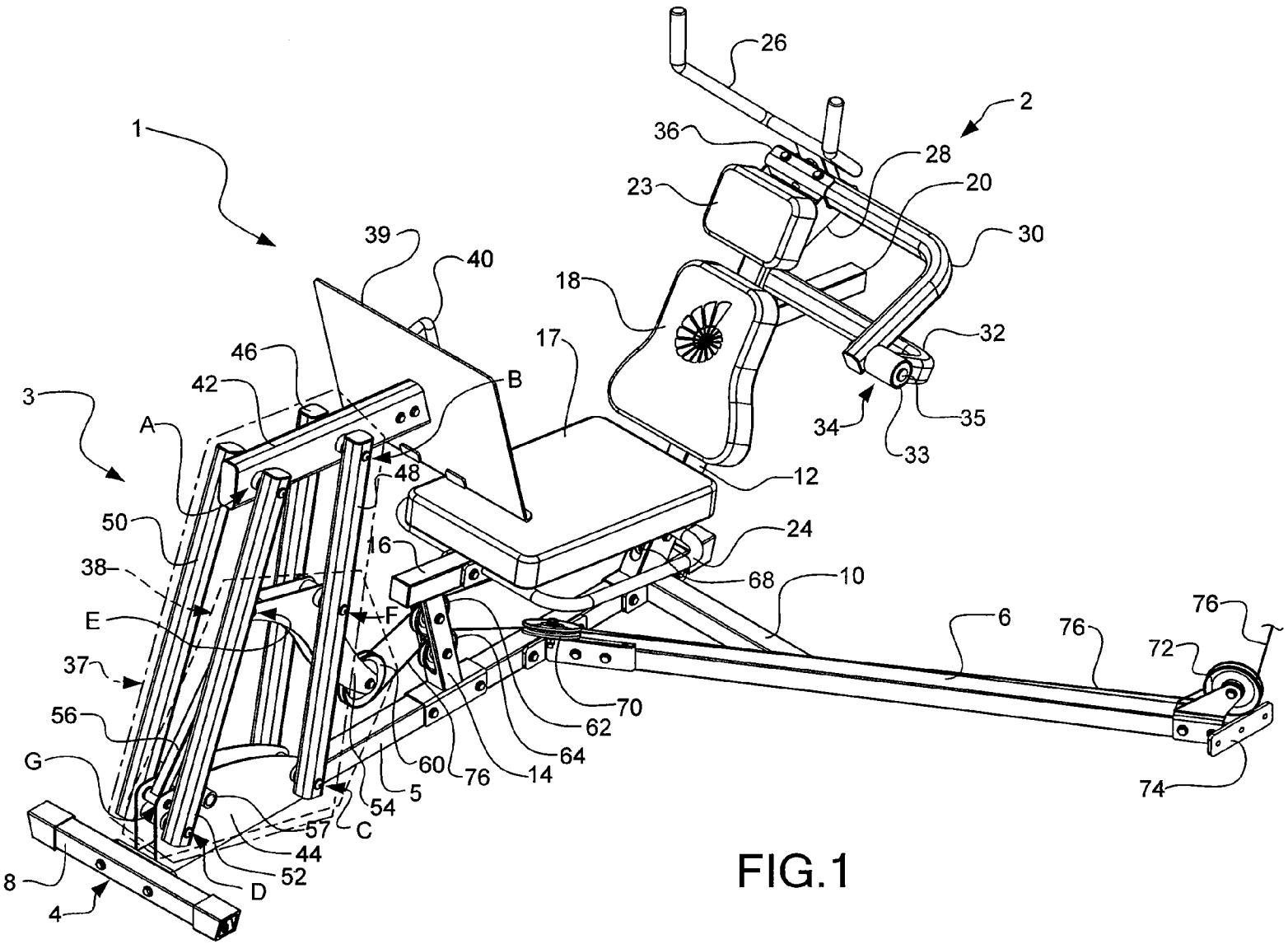
FIG. 1 is an isometric view of an exercise machine according to a first embodiment of the invention.

The exercise machine of the present invention may be realized in multiple embodiments, several of which are described herein as exemplary of the novel features of the invention. A first exemplary embodiment of a leg press/abdominal crunch exercise machine 1 (hereinafter "exercise machine 1") is depicted in FIGS. 1-7. The exercise machine 1 may be characterized as having two portions based upon the types of exercises it offers to a user: an abdominal crunch portion 2 and a leg press portion 3. The exercise machine 1 is built upon a frame 4. The frame 4 is composed of several sections, including a base rail 5, a weight stack attachment rail 6, a front stabilizer bar 8, a rear stabilizer bar 10, a rear seat post 12, a front seat post 14, and a seat bar 16. The various bars and post that compose the frame 4 may be, for example, straight, tubular (e.g., round or square), metal (e.g., steel) beams that are attached together, for example, with brackets and through bolts. Such brackets may be separate pieces or integral with the various bars and posts.

Figure 2:
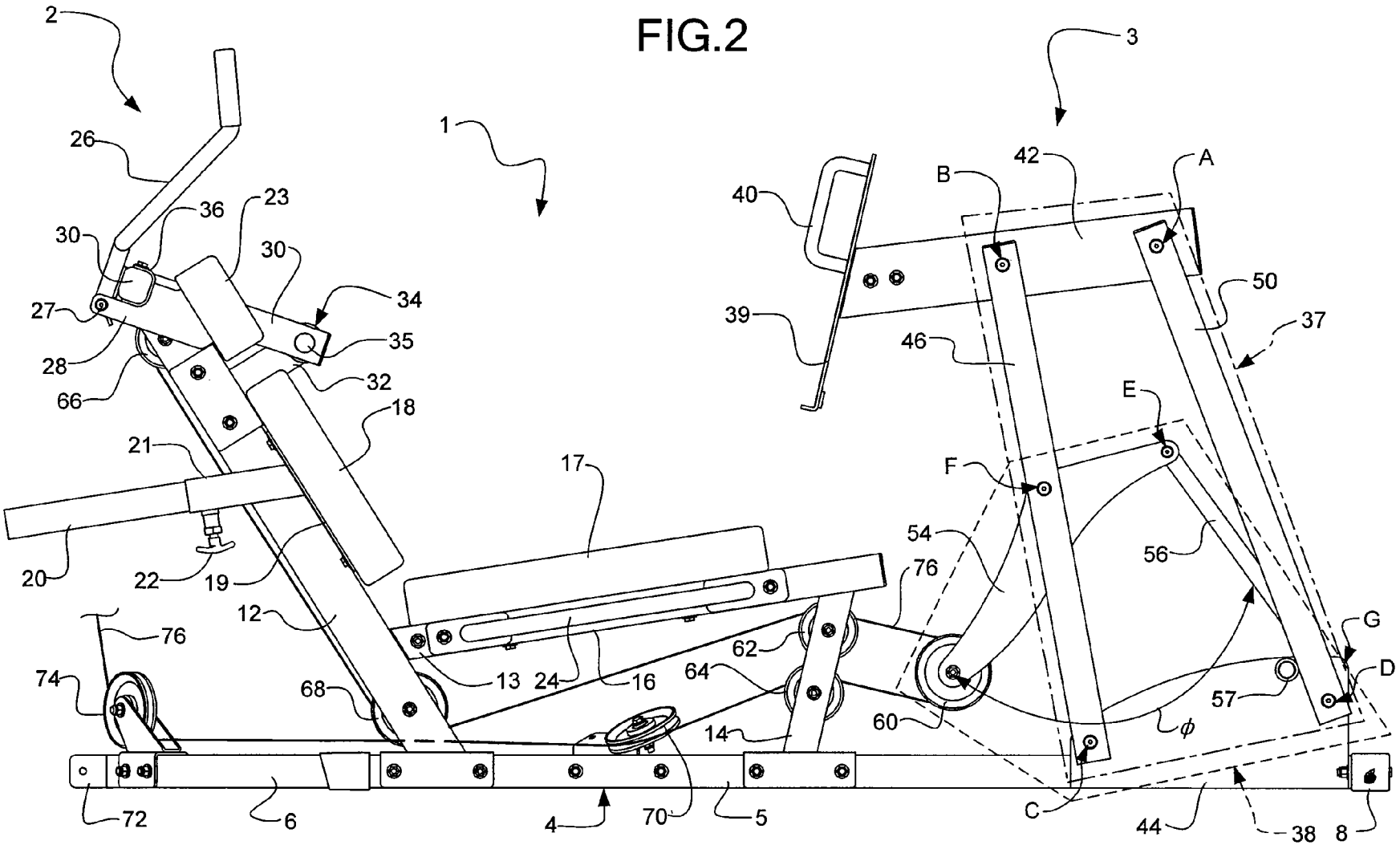
FIG. 2 is a left side elevation of the exercise machine of the first embodiment of the invention with both the leg press portion and the abdominal crunch portion in rest positions.

The base rail 5 is the foundation of the frame 4 and generally rests flat upon a floor surface. The base rail 5 generally extends the length of the exercise machine 1 as shown in FIG. 2. Attached to the front end and rear end of the base rail 5 are the front stabilizer bar 8 and rear stabilizer bar 10, respectively. The front and rear stabilizer bars 8, 10 provide lateral support to prevent the exercise machine 1 from tipping over onto either the left or right side. The rear stabilizer bar 10 may be attached to or integral with the weight stack attachment rail 6, as shown in FIG. 1.

As used herein, "front" refers generally to the end of the exercise machine 1 having the leg press portion 3 and "back" refers generally to the end of the exercise machine 1 having the abdominal crunch portion 2. Also, as used herein, "left" refers generally to the left side of the exercise machine 1 as viewed from the front end and "right" refers generally to the right side of the exercise machine 1 as viewed from the front end (i.e., the side from which the weight stack attachment rail 6 extends).

The weight stack attachment rail 6 extending from the right side of the base rail 5 physically connects the exercise machine 1 to a weight stack (not shown) via weight stack bracket 74. The weight stack provide a resistance force employed by the exercise machine 1. The exercise machine 1 may be one of several machines providing different exercises attached to the weight stack in a circuit training configuration wherein each of the machines shares the resistance force provided by the weight stack. The weight stack attachment rail 6 may further provide additional lateral stabilization for the exercise machine 1 of FIGS. 1-7. It should be apparent that the exercise machine 1 may be physically attached to the weight stack by any of a variety of means and at any of a variety of locations. In some embodiments, it may be unnecessary to attach the exercise machine 1 to the weight stack; for example, the exercise machine 1 and the weight stack may be fixedly mounted with respect to each other. Further, the resistance force may be provided by some means other than a weight stack, for example, a hydraulic resistance system, a friction resistance system, a tension resistance system, and a flexion resistance system.

The front seat post 14 may be attached, generally medially, to the base rail 5 to extend upward. The rear seat post 12 may be attached to the base rail 5 toward the rear end of the base rail 5, also extending upward. The seat bar 16 is supported by and attached to the front seat post 14 and the rear seat post 12. The rear seat post 12 may have a seat support extension 13 extending toward the front of the exercise machine 1 for attachment to the seat bar 16. The seat bar 16 may fit over and around the seat support extension 13 or vice versa. The front seat post 14 may extend higher than the seat support extension to provide an incline of the seat bar 16 from the rear toward the front.

The seat bar 16 may further support a seat pad 17 upon which a user may sit while performing exercises on the exercise machine 1. The seat bar 16 may also support grip rails 24 attached along the left and right sides of the seat bar 16 and extending beyond the width of the seat pad 18. The grip rails 24 may be grasped by the hands of the user to provide support to the user while performing exercises on the exercise machine 1. Similarly, the rear seat post 12 may support a back rest 18 against which the user may lean when performing exercises. The back rest 18 may be attached to a back rest plate 19 mounted on a back rest bar 20 insertable into a back rest sleeve 21 mounted on the rear seat post 16. The back rest bar 20 may slide within the back rest sleeve 21 to provide a variable position of the back rest 18 for the user. The back rest bar 20 may be alterably attached to the back rest sleeve 21 by a spring pin 22 fixed to the back rest sleeve 21 that engages one of a plurality of apertures along the back rest bar 20.

Figure 9:
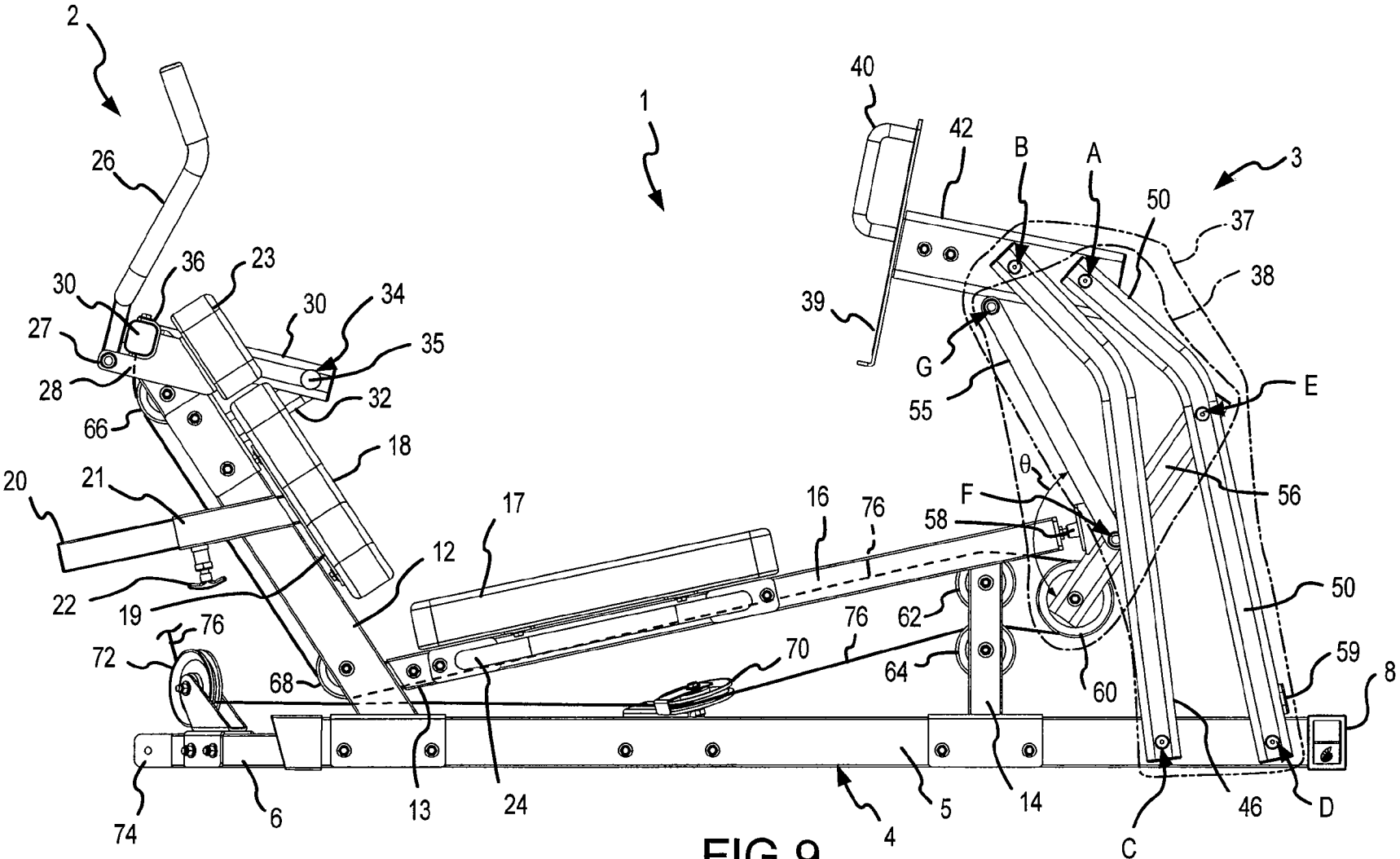
FIG. 9 is a left side elevation of the exercise machine of the second embodiment of the invention with both the leg press portion and the abdominal crunch portion in rest positions.

The top of the rear seat post 12 may further support a head rest frame 28, which rests atop the rear seat post 12. A head rest 23 may be mounted to the head rest frame 28 and lay flush against the rear seat post 12 parallel to the back rest 18 when the abdominal crunch portion 2 is in a rest position, as shown in FIG. 2. The head rest frame 28 may support a handlebar 26 for grasping by a user to perform an abdominal crunch exercise. The head rest frame 28 may further be connected to the upper abdominal arm 30 by an arm bracket 36 portion to which the upper abdominal arm 30 is fixedly mounted. The handlebar 26 may be mounted to the head rest frame 28 behind the upper abdominal arm 28 by a hinge 27 connection. The hinge 27 allows a user to move the handlebar 26 out of the way when mounting the exercise machine 1. The head rest frame 28 may also act as a termination point for a cable 76 (e.g., as shown in FIG. 9) connected through a pulley system (as described in detail infra) to a resistance force, e.g., a weight stack.

A lower abdominal arm 32 may be mounted to the rear seat post 12 between the back rest sleeve 21 and the top of the rear seat post 12, underneath the head rest frame 28. The distal end of the lower abdominal arm 32 may include an arm hinge bearing 33. The upper abdominal arm 30 may have an arm hinge pin 35 on a distal end from the frame 4 for operably connecting with the arm hinge bearing 33 to create a an abdominal arm hinge 34 between the lower abdominal arm 32 and the upper abdominal arm 30. Both the upper abdominal arm 30 and the lower abdominal arm 32 may extend laterally from the right side of the frame 4, perpendicular the vertical orientation of the rear seat post 12. The upper abdominal arm 30 and the lower abdominal arm 32 may also be bent at an angle, for example, at approximately 90°, along their lengths, whereby the abdominal arm hinge 34 is formed in a plane spaced a part from a plane including the lateral extensions of the upper abdominal arm 30 and the lower abdominal arm 32 when the abdominal crunch portion 2 is in a rest position, as shown in FIG. 2. In this manner, the abdominal arm hinge 34 is positioned further toward the front of the exercise machine 1 than the rear seat post 12 at the same height.

The user may grasp the handlebar 26 with his hands above his head. The positioning of the abdominal arm hinge 34 allows the head rest 23 to remain behind the head of a user, and the handlebar 26 to maintain a constant positional relationship with the head rest 23, during the movement of an abdominal crunch exercise as the user bends his head and upper body toward his legs. The cable 76 provides resistance against the user as he pulls on the handlebar 26 during the abdominal crunch exercise. While the lower abdominal arm 32 remains fixed, the upper abdominal arm 30 rotates about the abdominal arm hinge 34, allowing the user's arms to move forward and downward while remaining over the user's head during the exercise.

The leg press portion 3 of the exercise machine 1 is mounted on the frame 4 in front of the front seat post 14. The leg press portion 3 according to the first embodiment of the exercise machine 1 is composed primarily of a first four bar linkage system 37, a second four bar linkage system 38, and a structure for engaging the feet or lower legs of the user, in this case, a foot plate 39. The first four bar linkage system 37 may be formed by two pairs of generally vertical bars: a left rear bar 46, a right rear bar 48, a left front bar 50, and a right front bar 52; a foot plate bar 42; and, in this exemplary embodiment, a riser frame 44. The left rear bar 46 and the right rear bar 48 may together be considered one of the four sides of the first four bar linkage system 37. In one exemplary embodiment, the left rear bar 46 and the right rear bar 48 may each be approximately 73.6 cm long between pivot point B and pivot point C. Similarly, the left front bar 50 and the right front bar 52 may together be considered another of the four sides of the first four bar linkage system 37. In the exemplary embodiment, the left front bar 50 and the right front bar 52 may each be approximately 73.6 cm long between pivot point A and pivot point D.

The top ends of the left rear bar 46, the right rear bar 48, the left front bar 50, and the right front bar 52 may each be pivotally attached, generally transverse to the foot plate bar 42. The left front bar 50 and the right front bar 52 may be attached directly opposing each other on opposites sides of the foot plate bar 42 on an axel through the foot plate bar 42 at pivot point A. Likewise, the left rear bar 46 and the right rear bar 48 may be attached directly opposing each other on opposites sides of the foot plate bar 42 on an axel through the foot plate bar 42 at pivot point B. In the exemplary embodiment, the distance between pivot point A and pivot point B may be approximately 23.5 cm. The bottom ends of the left rear bar 46, the right rear bar 48, the left front bar 50, and the right front bar 52 may each be pivotally attached, generally transverse to the riser frame 44. The left rear bar 46 and the right rear bar 48 may be attached directly opposing each other on opposites sides of the riser frame 44 on an axel through the riser frame 44 at pivot point C. Likewise, the left front bar 50 and the right front bar 52 may be attached directly opposing each other on opposites sides of the riser frame 44 on an axel through the riser frame 44 at pivot point D. In the exemplary embodiment, the distance between pivot point C and pivot point D may be approximately 36.5 cm. The distance between pivot points C and D is greater than the distance between pivot points A and B.

The riser frame 44 may be mounted on or integral with the base rail 5. In the first embodiment, the riser frame 44 is composed of two flat panels on each side of and extending above the base rail 5. The riser frame 44 may be used to provide clearance between the bottoms of the left rear bar 46, the right rear bar 48, the left front bar 50, and the right front bar 52 of the first four bar linkage system 37 and the floor on which the exercise machine 1 may rest. The riser frame 44 may further provide for a vertical offset between pivot point C and pivot point D to affect the motion of the first four bar linkage system 37 as desired. In one exemplary embodiment, the vertical offset between pivot point C and pivot point D is approximately 6 cm. However, it should be noted that in some embodiments a riser frame 44 may not be necessary or desirable and the pivot points C and D may be located, for example, on the base rail 5 (as in the second embodiment of FIGS. 8-14). The riser frame 44 may further have a stop pin 57, for example, a shaft extending from either the left side, the right side, or both sides of the riser frame 44, to impede the motion of the first four bar linkage system 37 in the rearward direction. The stop pin 57 defines the rest position of the leg press portion 3 of the exercise machine 1 and prevents the cable 76 from pulling the leg press portion closer to the rear of the exercise machine 1.

The foot plate 39 may be fixedly mounted to the rear end of the foot plate bar 42. A foot plate handle 40 may be provided on the foot plate 39 for aiding the user in mounting the exercise machine 1. When a user places his feet against the foot plate 39 in the resting position, the lower legs of the user (i.e., between the knees and ankles) should be normal to the plane of the foot plate 39. The back rest 18 may be adjusted forward or backward along the back rest bar 20 to help appropriately position the user and the user's legs vis-à-vis the foot plate 39. When the user extends his legs, the first four bar linkage system 37 defines a movement about an instantaneous (i.e., constantly changing) axis of rotation that maintains the foot plate 39 in a position normal to the lower legs of the user. That is, the angle of inclination of the foot plate 39 changes throughout the back and forth movement of the leg press exercise to maintain a position normal to the user's lower legs. In this manner, the first four bar linkage system 37 of the exercise machine 1 is able to better focus the resistance force on the desired muscle groups of the user throughout the entire movement of the leg press exercise.

A second four bar linkage system 38 is operably connected to the first four bar linkage system 37. The second four bar linkage system 38 is also operably connected with the cable 76, and thereby with the resistance force, and is designed to create a positive or increasing force curve throughout the extension of the user's legs during a leg press exercise. Stated in another way, the second four bar linkage system 38 operates to decrease the mechanical advantage of the user as the user extends his legs during the leg press exercise. Conversely, the second four bar linkage system 38 increases the mechanical advantage of the resistance force as applied through the cable 76.

The second four bar linkage system 38 may actually be formed from part of the first four bar linkage system 37. In the first embodiment of the exercise machine of FIGS. 1-7, the second four bar linkage system 38 is composed of a rear tension frame 54, a front tension bar 56, a portion of each of the left rear bar 46 and the right rear bar 48, and the riser frame 44. The front tension bar 56 is operably mounted to the rear tension frame 54 at pivot point E, for example, with a bolt or hinge, and similarly operably mounted to the riser frame 44 at pivot point G. In one exemplary embodiment, the distance between pivot point E and pivot point G may be approximately 41.5 cm, and pivot point G may be located on the riser frame 44 approximately 4 cm from pivot point C and at approximately a 7° above a line intersecting pivot points C and D. Alternatively, the front tension bar 56 may be mounted on the same shaft connecting the left front bar 50 and the right front bar 52 to the riser frame 44 at pivot point D, if desired, without significantly impacting the functionality of the second four bar linkage system 38. The rear tension frame 54 is operably mounted to the left rear bar 46 and the right rear bar 48 at a pivot point F between the top and the bottom of the left rear bar 46 and the right rear bar 48. The third member of the second four bar linkage system 38 is composed of the portions of the left rear bar 46 and right rear bar 48 between pivot point F and pivot point C on the riser frame 44. In one exemplary embodiment, the distance between pivot points F and C is approximately 39 cm. The fourth member of the second four bar linkage system 38 is the riser frame 44 between pivot point C and pivot point G. The pivot points and the lengths of the components of the first four bar linkage system 37 and the second four bar linkage system 38 may be altered or modified as desired to vary the resultant force curve and change the level of mechanical disadvantage to the user.

The rear tension frame 54 may extend rearward and downward beyond the left rear bar 46 and the right rear bar 48 toward the front seat post 14. The rear tension frame 54 may be angled or curved downward to help achieve the desired positive force curve during the exercise or to provide clearance between other components of the exercise machine 1. A leg press pulley 60 may be rotationally mounted on a shaft at the rear end of the rear tension frame 54 for operable connection with the cable 76 (as discussed with respect to FIGS. 1 and 2, infra) to supply the resistance force to the leg press portion 3 of the exercise machine 1. In one exemplary embodiment, the angle formed in the rear tension frame 54 between pivot point E, pivot point F, and the shaft of the leg press pulley 60, where pivot point F is the vertex, is approximately 132°. The shaft forming the stop pin 57 may also extend through the riser frame 44 to impede the forward motion of the rear tension frame 54 and act as a limitation on a maximum extension position, as shown in FIG. 3.

Figure 3:
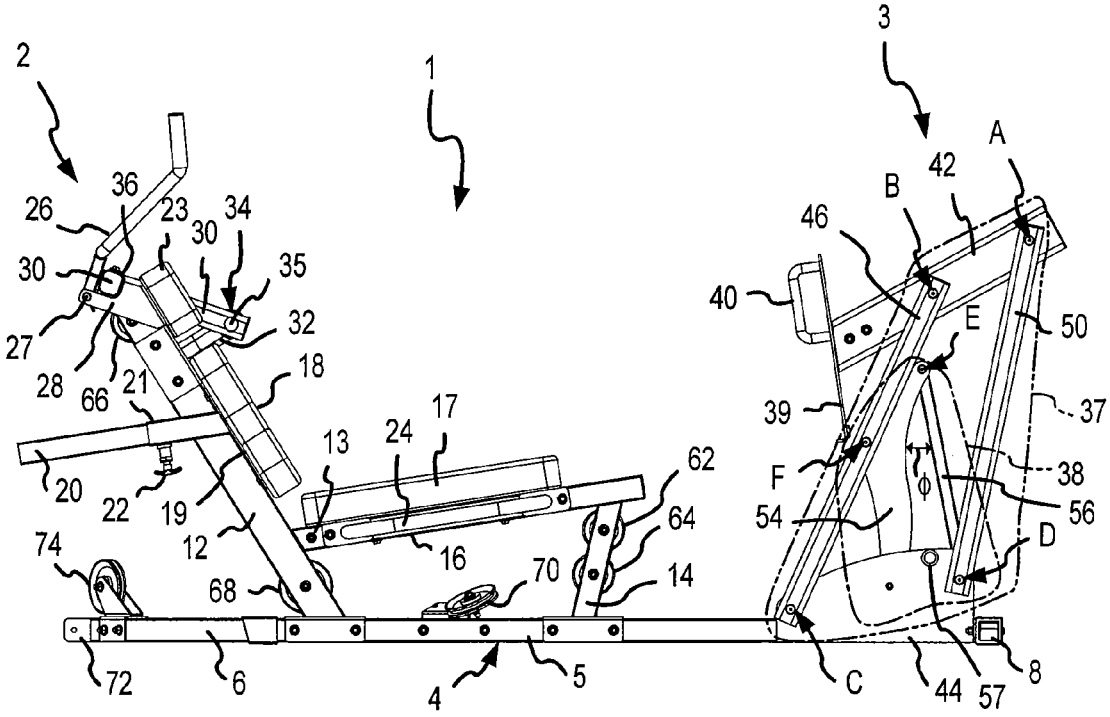
FIG. 3 is a left side elevation of the exercise machine of the first embodiment of the invention with the leg press portion in an extended position.
Figure 4:
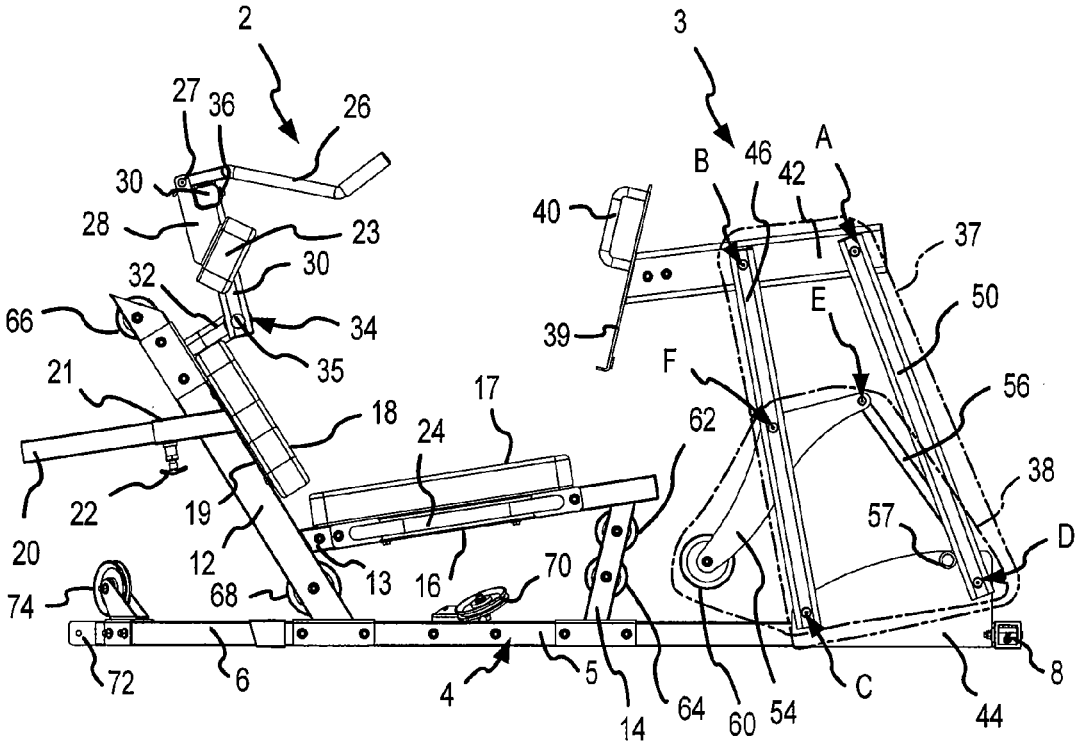
FIG. 4 is a left side elevation of the exercise machine of the first embodiment of the invention with the abdominal crunch portion in an extended position.
Figure 6:
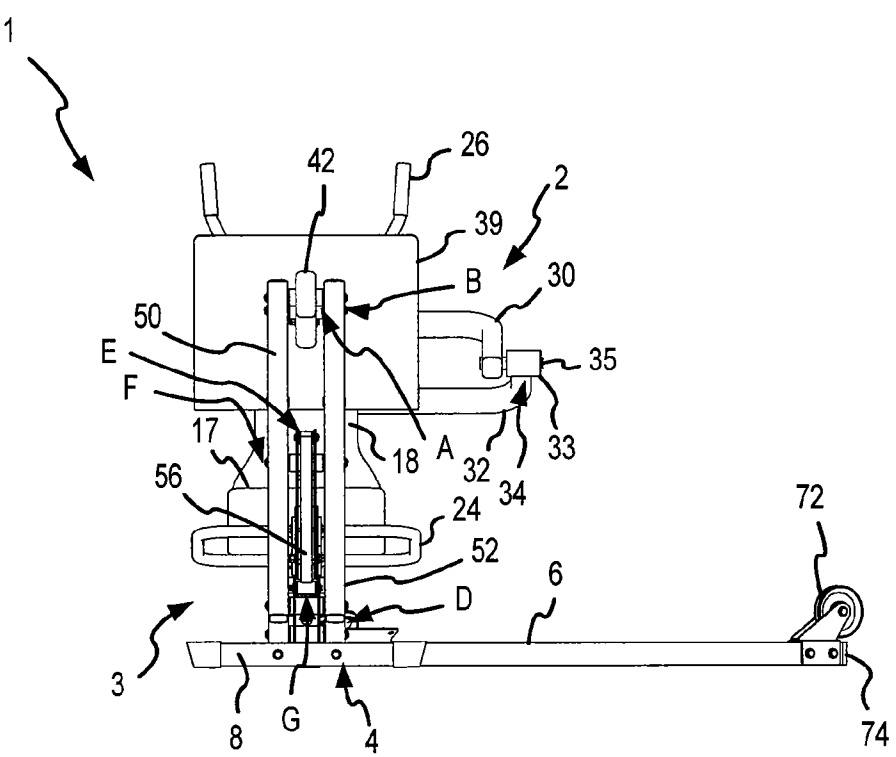
FIG. 6 is a plan view of the exercise machine of the first embodiment of the invention.
Figure 5:
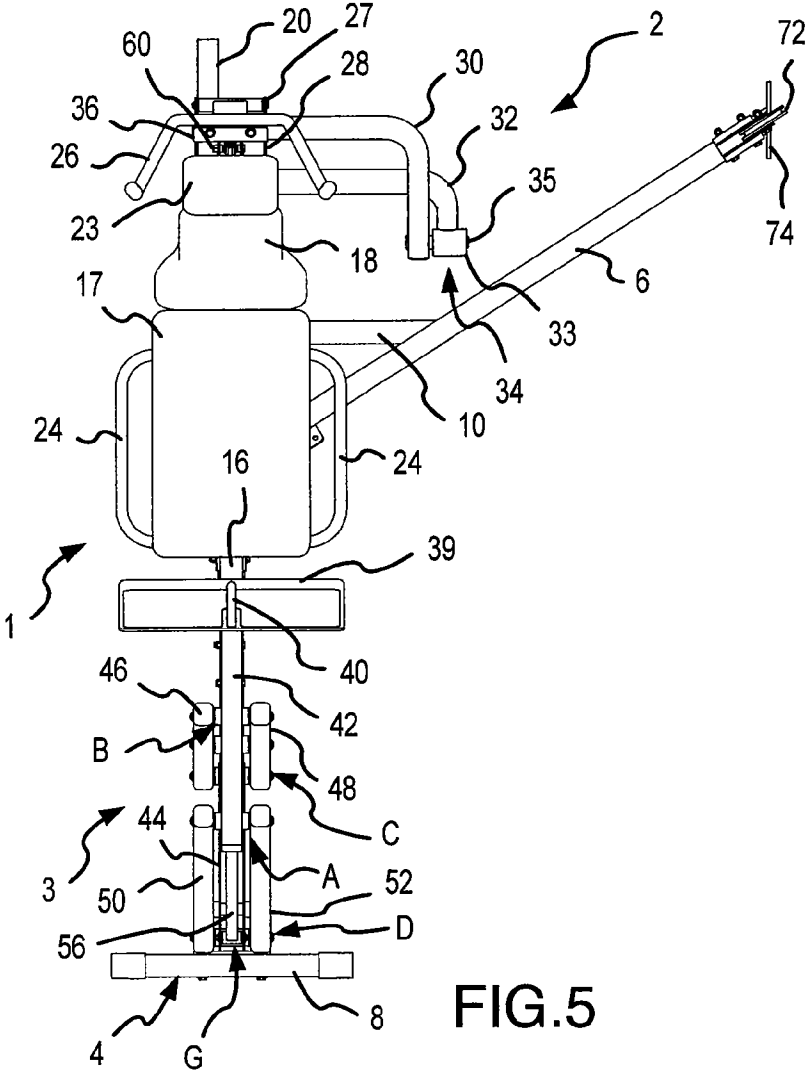
FIG. 5 is a front elevation of the exercise machine of the first embodiment of the invention.
Figure 7:
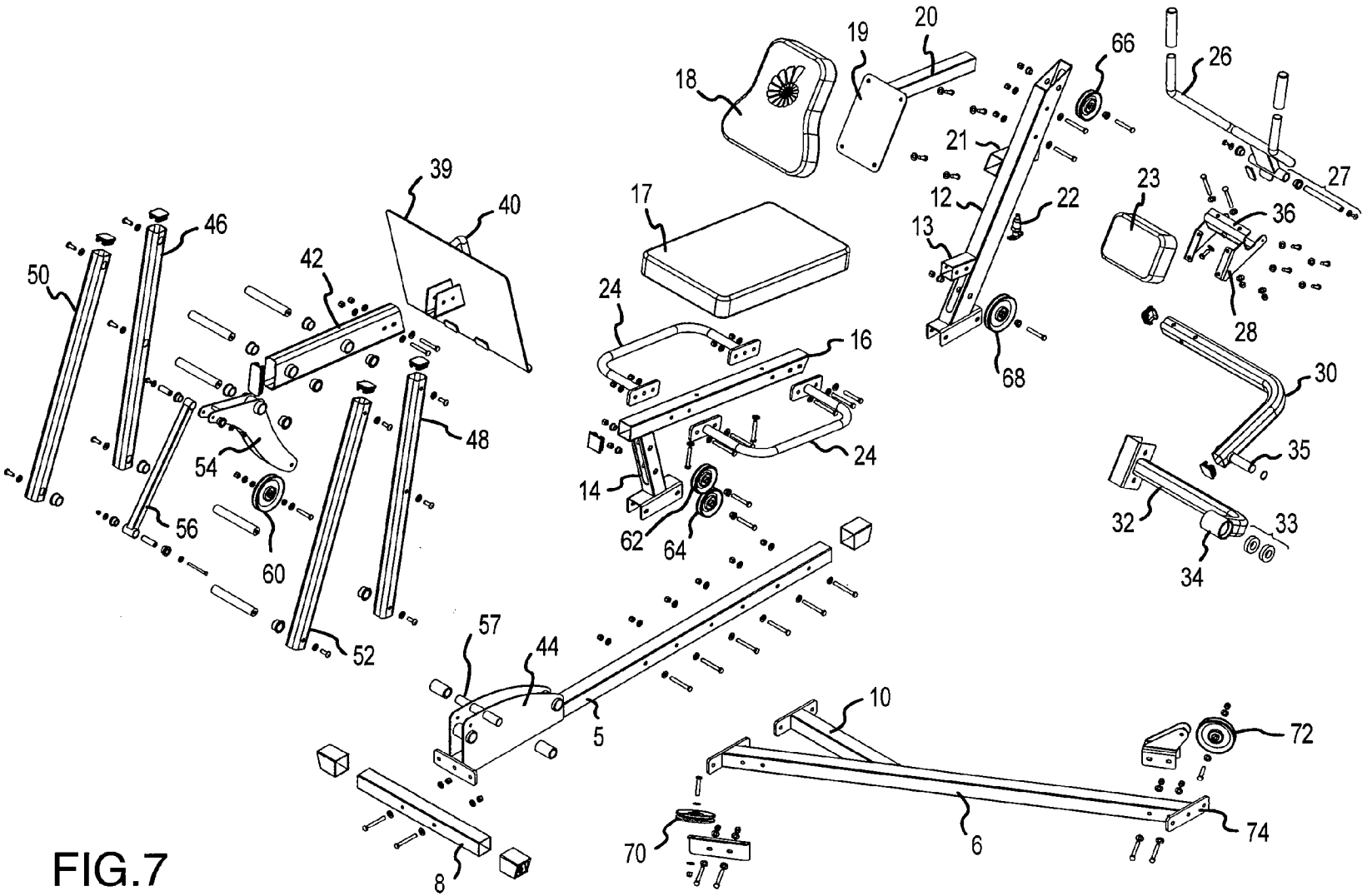
FIG. 7 is an exploded view of the exercise machine of the first embodiment of the invention.

The decrease in the mechanical advantage of the user during the course of a leg press exercise can be seen by comparing the position of the second four bar linkage system 38 in the resting state, as shown in FIG. 2, and in the extended state, as shown in FIG. 3. The angle $\phi$ between the front tension bar 56 and the rear tension frame 54 with a vertex at pivot point E is approximately 111° when the second four bar linkage system 38 is in the resting position. When the user presses the leg press portion 3 to the extended position, the angle $\phi$ between the front tension bar 56 and the rear tension frame 54 decreases to approximately 49°. While the resistance force on the cable 76 remains constant, the movement of the second four bar linkage system 38, in conjunction with the first four bar linkage system 37, during a leg press increases the mechanical advantage from the perspective of the cable 76 and reduces the mechanical advantage of the user.

In this manner, the combination of the first four bar linkage system 37 with one or more additional linkage bars operates as a force conditioning device. That is, by operably connecting the first four bar linkage system 37, which is primarily for maintaining a normal interface with the lower leg of the user, with one or more additional linkage bars, a mechanical advantage is allocated to a first force, e.g., the tension on the cable 76, acting on the leg press portion 3 of the exercise machine 1 in opposition to a second force, e.g., the force of the user's leg acting on the foot plate 39. The mechanical advantage gained or mechanical disadvantage imposed, depending upon the perspective, by the components of the leg press portion 3 may be viewed as a conditioning of the forces acting upon the exercise machine 1. In the embodiments described herein, generally two additional bars have been added to the first four bar linkage system 37. These two bars are operably engaged with each other and a portion of the first four bar linkage system 37 resulting in a second four bar linkage system 38. However, it is conceivable that the addition of only one bar, or the addition of more than two bars, may be used to achieve similar force conditioning effects. For example, using an appropriately shaped bar and/or movable pivot points, e.g., a channel lock-type connecting, together with a first four bar linkage system 37 could provide the desired mechanical advantage.

Figure 15A:
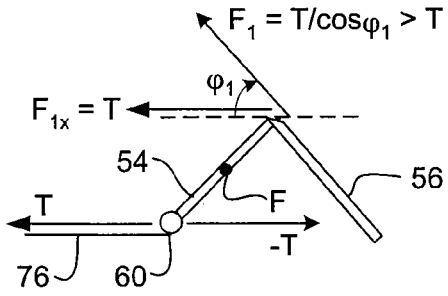
FIGS. 15A-B are geometric representations of the decrease in mechanical advantage to a user of the exercise machine of the first embodiment of the invention while performing leg press.
Figure 15B:
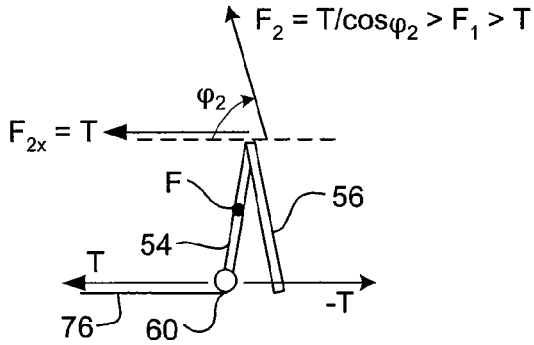

The reduction in the mechanical advantage of the user is apparent through the application of basic principles of physics. FIGS. 15A-B depict a simplified illustration of the decrease in mechanical advantage to a user created by the combination of the first four bar linkage system 37 and the second four bar linkage system 38. FIG. 15A is a simplified representation of the forces acting on the leg press portion 3 in the resting position of FIG. 2. Cable 76 provides tension T on the leg press pulley 60. In order to counteract the force of tension T, at least an equal and opposite opposing force of −T must be applied to the leg press pulley 60. Leg press pulley 60 is mounted on one end of the rear tension frame 54 and the opposing end of the rear tension frame 54 is connected to front tension bar 56. Rear tension frame 54 further rotates about pivot point F.

A force may be applied to the top of the rear tension frame 54, and translated by pivot point F through the rear tension frame 54 to leg press pulley 60 at the bottom end of the rear tension frame 54, into the desired opposing force −T. This force $F_1$ is supplied by the front tension bar 56 pushing against the top of the rear tension frame 54 at pivot point E. Force $F_1$ is, however, at an angle $\phi_1$ to the horizontal direction of tension T. Therefore, only the horizontal component $F_{1x}$ of force $F_1$ is able to act in opposition to tension T. The magnitude of force $F_1$ with a horizontal component $F_{1x}$ equal to T is $T/\cos\phi_1$, which is a force greater than tension T. The force $F_1$ is supplied by the user pressing against the foot plate, which is translated through the first four bar linkage system 37 to the front tension bar 56 of the second four bar linkage system 38.

A simplified representation of the forces acting on the leg press portion 3 in the extended position of FIG. 3 is shown in FIG. 15B to provide a comparison to the resting position forces and illustrate the resulting increase in the force curve. Assuming the same tension T on the leg press pulley 60, an opposing force −T, a force equal and opposite to T, must again be applied to the leg press pulley 60. This force may again be applied to the top of the rear tension frame 54 at pivot point E and translated through the pivot point F to the leg press pulley 60. The force $F_2$ is supplied by the front tension bar 56 pushing against the top of the rear tension frame 54. Force $F_2$ is, however, at an angle $\phi_2$ to the horizontal direction of tension T. Therefore, only the horizontal component $F_{2x}$ of force $F_2$ is able to act in opposition to tension T. The magnitude of force $F_2$ with a horizontal component $F_{2x}$ equal to T is $T/\cos\phi_2$, which is a force greater than tension T. As angle $\phi_2$ is greater than angle $\phi_1$, force $F_2$ is also greater than $F_1$.

As indicated, the representations of FIGS. 15A-B are greatly simplified and do not take into account the effect on the magnitude of forces required to counter tension T, for example, by the angle of incidence of the force provided by the user's legs, the angled design of the rear tension frame 54, the torque advantage of the rear tension frame 54 due to pivot point F, the instantaneous changes in configuration of the first four bar linkage system 37 and the second four bar linkage system 38, and the interaction between the first four bar linkage system 37 and the second four bar linkage system 38. However, the design of the exercise machine 1 does account for such factors and results in a force requirement on the user that is greater than the tension on the cable 76 and that continuously increases as the leg press portion 3 moves from the resting position to the extended position.

Figure 16:
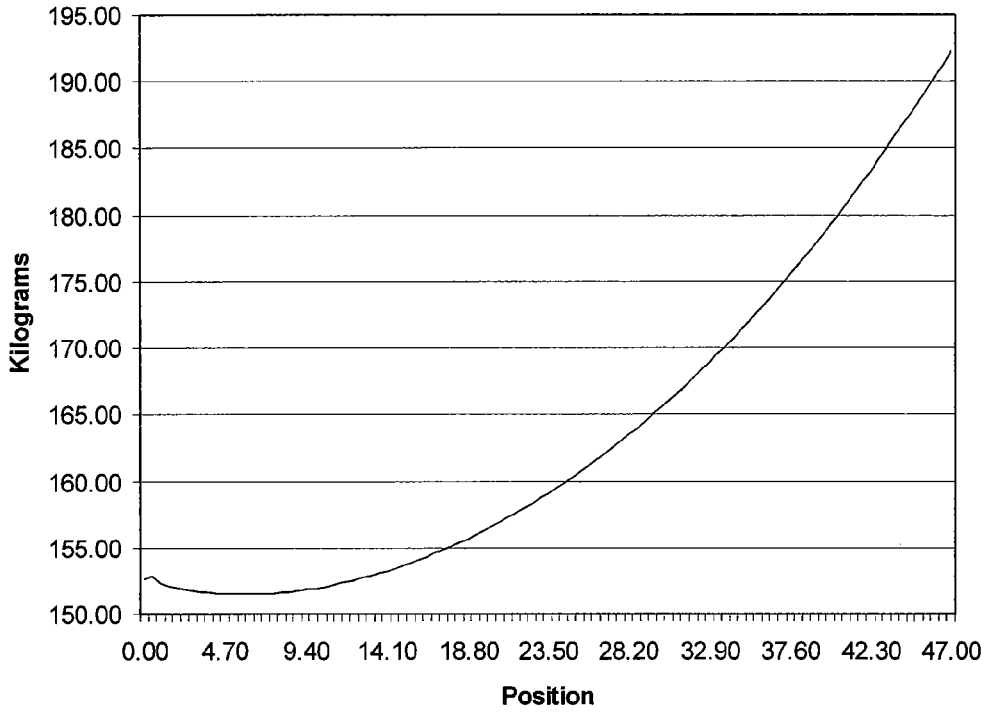
FIG. 16 is a graph of a force curve indicating the resistance force encountered by a user of the exercise machine of the first embodiment of the invention while performing leg press.

FIG. 16 shows the decrease in mechanical advantage to the user translated into an increasing force curve throughout the extension of a user's legs during a leg press exercise using the exercise machine 1 of FIGS. 1-7. In the exemplary leg press exercise depicted by the graph of FIG. 16, a 90 kg mass was attached to the cable 76 and was acted upon by gravity to provide a constant resistance force. The horizontal axis indicating position is the position of the foot plate 39 during an extension movement. Rather than indicating an actual distance, understanding that the foot plate 39 is moving about an instantaneous axis, the position axis indicates equal time increments of a constant movement from the start position as shown in FIG. 2 to a fully extended position as shown in FIG. 3. As indicated in the graph of FIG. 16, the combination of the first four bar system 37 and the second four bar system 38 increases the effective force required of a user at the start position from 90 kg (under gravity) to approximately 153 kg (under gravity). Further, as the user extends his legs through the exercise, the effective force required to counter the resistance force is generally constantly increasing, up to approximately 193 kg (under gravity) at the completion of a leg extension.

As previously indicated, the resistance force provided by the exercise machine 1 may be in the form of a weight stack (not shown) or other resistance system. The weight stack may be operably connected to both the abdominal crunch portion 2 and the leg press portion 3 of the exercise machine 1 by a single cable 76. At a first end the cable 76 is mounted to the head rest frame 28 such that the first end of the cable 76 is pulled by and moves with the head rest 23 and handlebar 26 during an abdominal crunch exercise. The cable 76 is threaded along a top rear seat post pulley 66, which is rotationally mounted on an axel near the top of the rear seat post 12, down the rear seat post 12 to bottom rear seat post pulley 68, which is rotationally mounted on an axel near the bottom of the rear seat post 12, where the direction of the cable 76 is changed. From the bottom rear seat post pulley 68, the cable 76 is routed under the seat bar 16 and threaded over the top of a top front seat post pulley 62, which is rotationally mounted on an axel near the top of the front seat post 14. The cable 76 is then threaded over the leg press pulley 60, whereby the cable 76 is directed in the opposite direction toward the rear of the exercise machine 1.

The cable 76 is then threaded over the top of a bottom front seat post pulley 64, which is rotationally mounted on a shaft near the bottom of the front seat post 14, and again routed under the seat bar 16. The cable 76 is then threaded around angular pulley 70, which is rotationally mounted at the intersection of the base rail 5 and the weight stack attachment rail 6. The angular pulley 70 may be mounted appropriately to translate the direction of the cable 76 along the length of the weight stack attachment rail 6. The cable 76 is routed along the weight stack attachment rail 6 and threaded around a weight stack pulley 72 that is rotationally mounted at the distal end of the weight stack attachment rail 6. Once the cable 76 has passed around the weight stack pulley 72, it may be connected to the resistance force directly, e.g., a weight stack, or it may be connected to a secondary cable (not shown) that is in turn connected to the resistance force.

Figure 8:
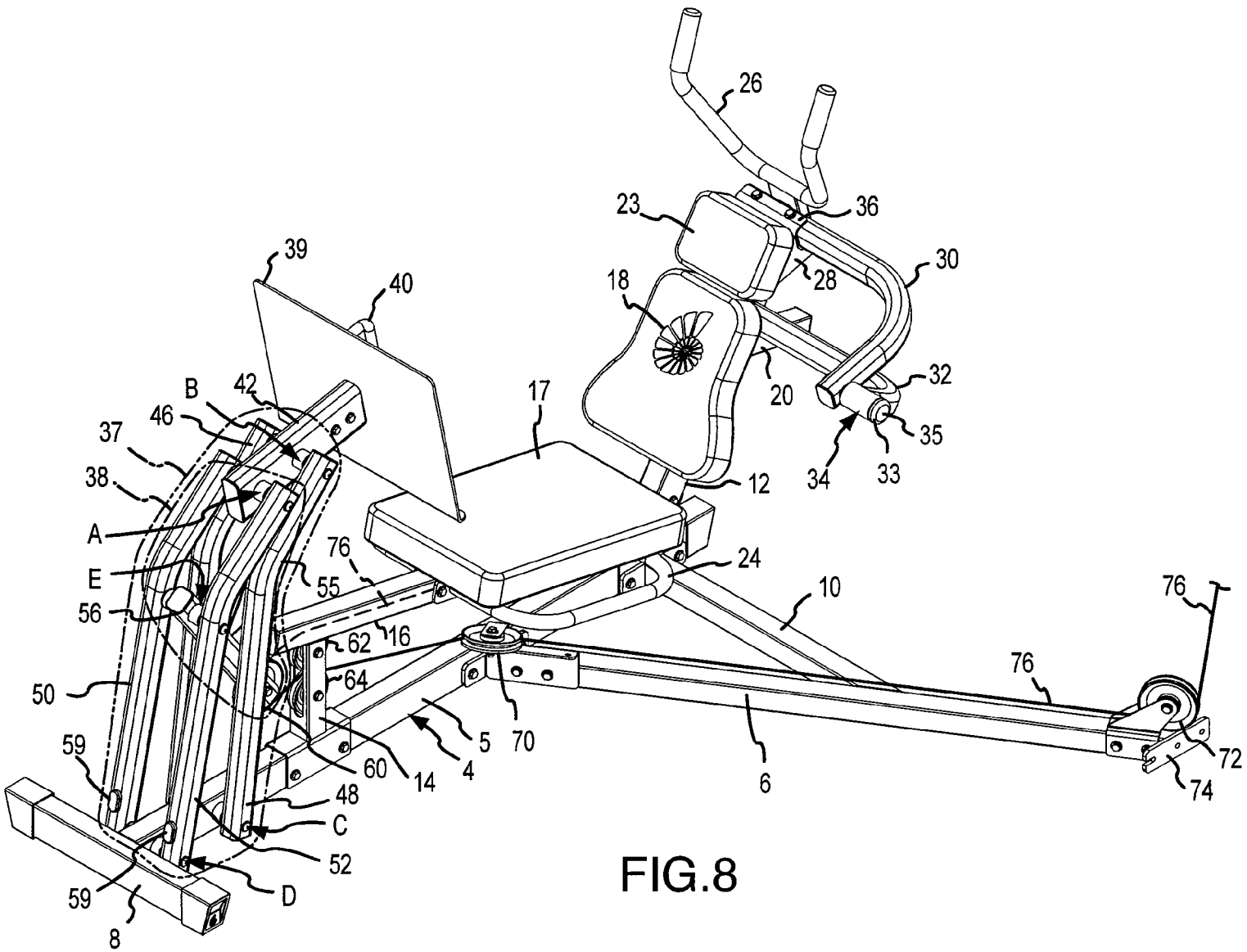
FIG. 8 is an isometric view of an exercise machine according to a second embodiment of the invention.

A second embodiment of the exercise machine 1 of the present invention is depicted in FIGS. 8-14. The frame 4, the abdominal crunch portion 2, and the pulley system (as shown in FIGS. 8 and 9) of the exercise machine 1 of the second embodiment are substantially the same as in the first embodiment. However, the leg press portion 3 of the exercise machine 1 is of an alternative design. As in the first embodiment, the leg press portion 3 of the exercise machine 1 is mounted on the frame 4 in front of the front seat post 14. Similarly, the leg press portion 3 according to the second embodiment of the exercise machine 1 is composed primarily of a first four bar linkage system 37, a second four bar linkage system 38, and a structure for engaging the feet or lower legs of the user, again depicted as a foot plate 39. In the second embodiment, the first four bar linkage system 37 may be formed by two pairs of generally vertically oriented bent bars: a left rear bar 46, a right rear bar 48, a left front bar 50, and a right front bar 52; a foot plate bar 42; and, in this exemplary embodiment, a portion of the base rail 5. The left rear bar 46 and the right rear bar 48 may together be considered one of the four sides of the first four bar linkage system 37. In one exemplary embodiment, the distance between pivot point B and pivot point C is approximately 74.3 cm. The left rear bar 46 and the right rear bar 48 may each be bent at approximately a 143° angle with a vertex located approximately 54.7 cm from pivot point C and approximately 21.7 cm from pivot point B. Similarly, the left front bar 50 and the right front bar 52 may together be considered another of the four sides of the first four bar linkage system 37. In the exemplary embodiment, the distance between pivot point A and pivot point D is approximately 74.3 cm. The left front bar 50 and the right front bar 52 may each be bent at approximately a 143° angle with a vertex located approximately 54.7 cm from pivot point D and approximately 21.7 cm from pivot point A.

The top ends of the left rear bar 46, the right rear bar 48, the left front bar 50, and the right front bar 52 of the second embodiment may each be pivotally attached, generally transverse to the foot plate bar 42. The left front bar 50 and the right front bar 52 may be attached directly opposing each other on opposites sides of the foot plate bar 42 on an axel through the foot plate bar 42 at pivot point A. Likewise, the left rear bar 46 and the right rear bar 48 may be attached directly opposing each other on opposites sides of the foot plate bar 42 on an axel through the foot plate bar 42 at pivot point B. In the exemplary embodiment, the distance between pivot point A and pivot point B may be approximately 10.7 cm. The bottom ends of the left rear bar 46, the right rear bar 48, the left front bar 50, and the right front bar 52 may each be pivotally attached, generally transverse to a portion of the base rail 5. The left rear bar 46 and the right rear bar 48 may be attached directly opposing each other on opposites sides of the base rail 5 on an axel through the base rail 5 at pivot point C. Likewise, the left front bar 50 and the right front bar 52 may be attached directly opposing each other on opposites sides of the base rail 5 on an axel through the base rail bar 5 at pivot point D. In the exemplary embodiment, the distance between pivot point C and pivot point D may be approximately 16.4 cm. The distance between pivot points C and D is greater than the distance between pivot points A and B.

The foot plate 39 may be fixedly mounted to the rear end of the foot plate bar 42. A foot plate handle 40 may be provided on the foot plate 39 for aiding the user in mounting the exercise machine 1. When a user places his feet against the foot plate 39 in the resting position, the lower legs of the user (i.e., between the knees and ankles) should be normal to the plane of the foot plate 39. The back rest 18 may be adjusted forward or backward along the back rest bar 20 to help appropriately position the user and the user's legs vis-à-vis the foot plate 39. When the user extends his legs, the first four bar linkage system 37 defines a movement about an instantaneous (i.e., constantly changing) axis of rotation that maintains the foot plate 39 in a position normal to the lower legs of the user. That is, the angle of inclination of the foot plate 39 changes throughout the back and forth movement of the leg press exercise to maintain a position normal to the user's lower legs. In this manner, the first four bar linkage system 37 of the exercise machine 1 is able to better focus the resistance force on the desired muscle groups of the user throughout the entire movement of the leg press exercise.

A second four bar linkage system 38 is operably connected to the first four bar linkage system 37. The second four bar linkage system 38 is also operably connected with the cable 76, and thereby with the resistance force, and is designed to create a positive or increasing force curve throughout the extension of the user's legs during a leg press exercise. Stated in another way, the second four bar linkage system 38 operates to decrease the mechanical advantage of the user as the user extends his legs during the leg press exercise. Conversely, the second four bar linkage system 38 increases the mechanical advantage of the resistance force as applied through the cable 76.

The second four bar linkage system 38 may actually be formed from part of the first four bar linkage system 37. In the second embodiment of the exercise machine 1 of FIGS. 8-14, the second four bar linkage system 38 is composed of a rear tension bar 55, a front tension bar 56, a portion of each of the left rear bar 46 and the right rear bar 48, and the foot plate bar 42. The front tension bar 56 is operably mounted to the rear tension bar 55 at pivot point F, for example, with a bolt or hinge, and similarly operably mounted between the left front bar 50 and the right front bar 52 at pivot point E between the top and the bottom of the left front bar 50 and the right front bar 52. In this exemplary embodiment, pivot point E is located approximately 0 cm from pivot point D and the distance between pivot point E and pivot point F along the front tension bar 56 is approximately 22.7 cm. The rear tension bar 55 is also operably mounted to the foot plate bar 42 at a pivot point G, which in this exemplary embodiment is located approximately 15 cm apart from point A and at approximately a 27° angle below a line intersecting pivot point A and pivot point B. In this exemplary embodiment, the distance between pivot points G and F along the rear tension bar 55 is approximately 39.5 cm. Alternatively, the rear tension bar 55 may be mounted on the same shaft connecting the left rear bar 46 and the right rear bar 48 to the foot plate bar 42 at pivot point B, if desired, without significantly impacting the functionality of the second four bar linkage system 38.

The third member of the second four bar linkage system 38 is composed of the portions of the left front bar 50 and right front bar 52 between pivot point A and pivot point E, which in this exemplary embodiment are approximately 26.5 cm apart. The fourth member of the second four bar linkage system 38 is the foot plate bar 42 between pivot point A and pivot point G. The pivot points and the lengths of the components of the first four bar linkage system 37 and the second four bar linkage system 38 may be altered or modified as desired to vary the resultant force curve and change the level of mechanical disadvantage to the user.

A leg press pulley 60 may be rotationally mounted on a shaft at the rearward extending end of the front tension bar 56, below pivot point F for operable connection with the cable 76 (as shown in FIGS. 8 and 9) to supply the resistance force to the leg press portion 3 of the exercise machine 1. The front end of the seat bar 16 may have a stop bumper 58 for engaging the front tension bar 56 to impede the motion of both the first four bar linkage system 37 and the second four bar linkage system 38 in the rearward direction. When the front tension bar 56 engages the stop bumper, the leg press portion 3 of the exercise machine is in the resting position indicated in FIG. 9.

Additionally, left front bar 50 and right front bar 52 may each have a stop pad 59 located toward the bottom of each of the bars. The left front bar 50 and the right front bar 52 may engage the front stabilizer bar 8 at the location of the stop pads 59, impeding the motion of both the first four bar linkage system 37 and the second four bar linkage system 38 in the forward direction, thus indicating the maximum extended position, as shown in FIG. 10.

Figure 10:
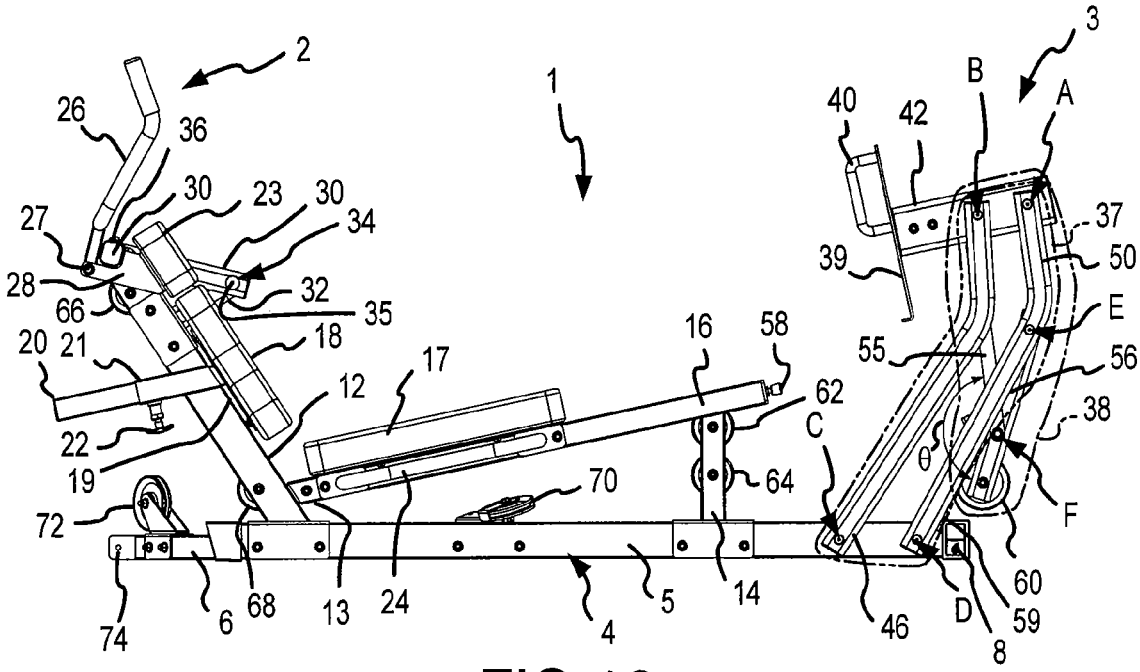
FIG. 10 is a left side elevation of the exercise machine of the second embodiment of the invention with the leg press portion in an extended position.
Figure 11:
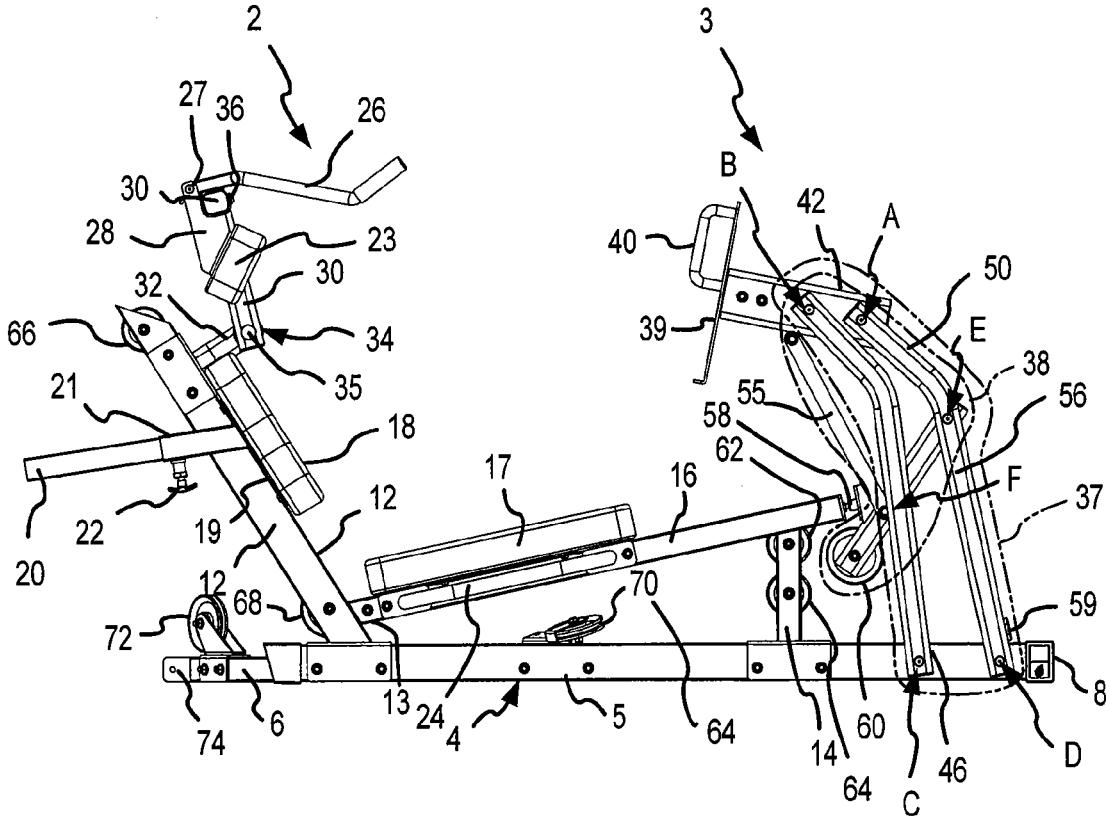
FIG. 11 is a left side elevation of the exercise machine of the second embodiment of the invention with the abdominal crunch portion in an extended position.
Figure 13:
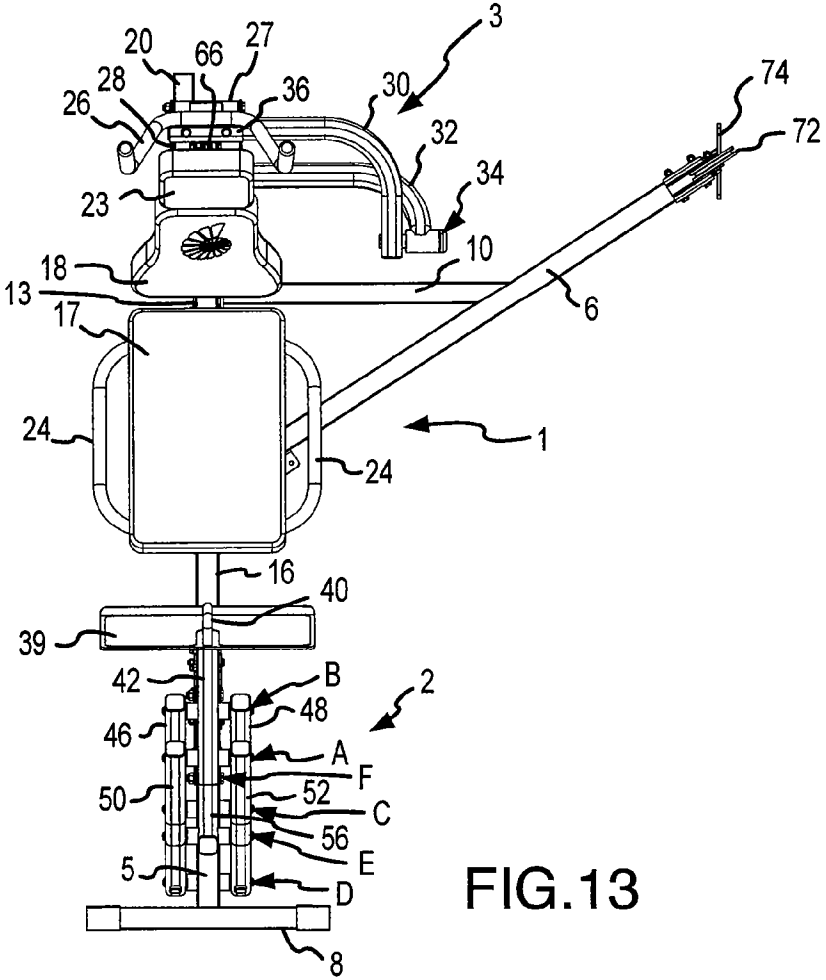
FIG. 13 is a plan view of the exercise machine of the second embodiment of the invention.
Figure 12:
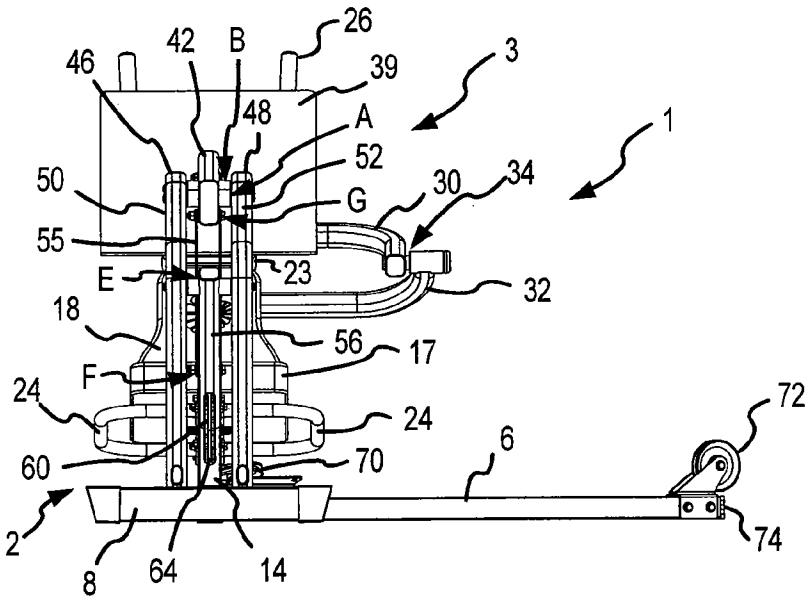
FIG. 12 is a front elevation of the exercise machine of the second embodiment of the invention.
Figure 14:
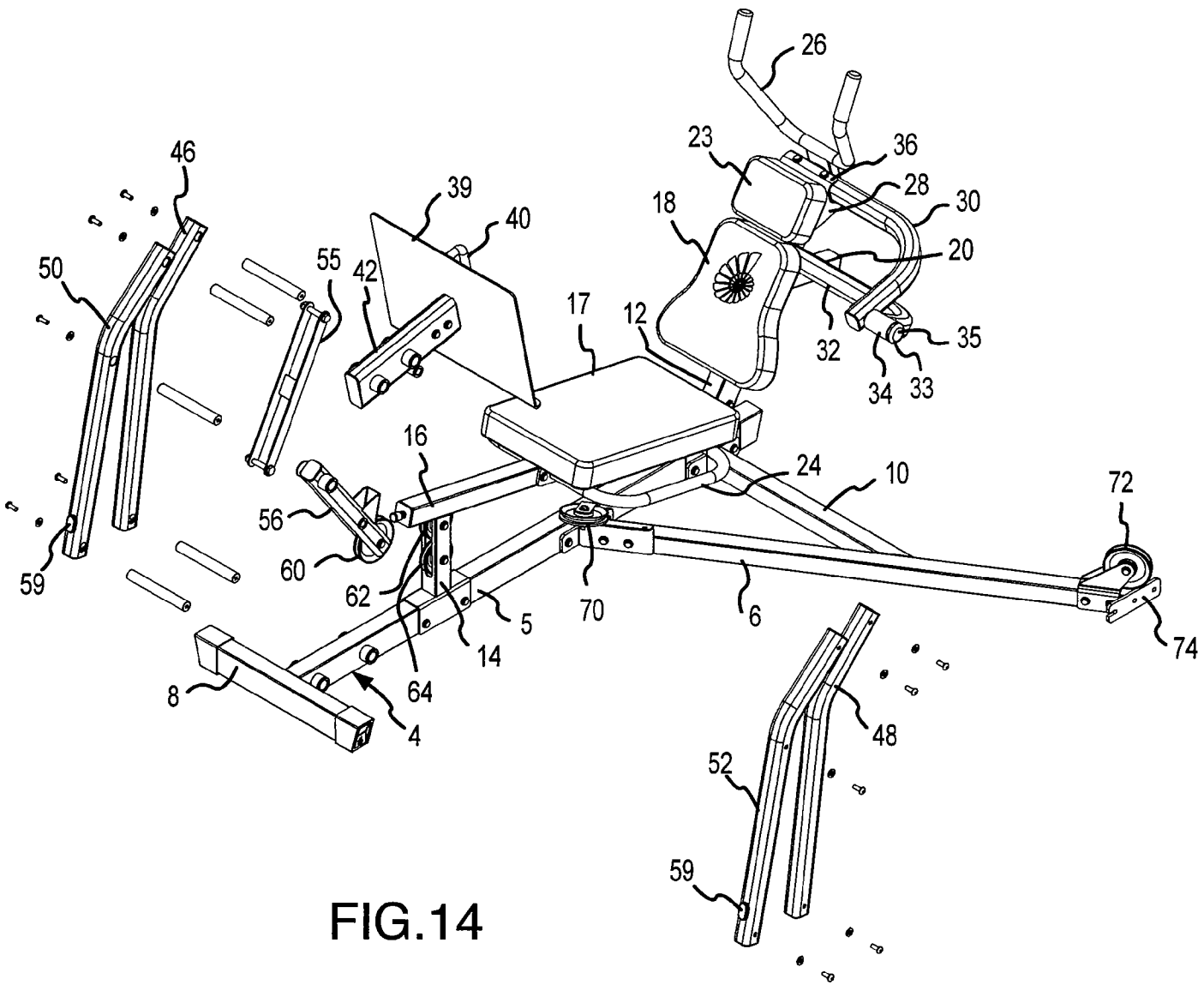
FIG. 14 is an exploded view of the exercise machine of the second embodiment of the invention.

The decrease in the mechanical advantage of the user during the course of a leg press exercise can be seen by comparing the position of the second four bar linkage system 38 in the resting state, as shown in FIG. 9, and in the extended state, as shown in FIG. 10. The interior angle θ between the front tension bar 56 and the rear tension bar 55, formed between pivot point G, pivot point F, and the axel of leg press pulley 60, with a vertex at pivot point F, is approximately 117° when the second four bar linkage system 38 is in the resting position. When the user presses the leg press portion 3 to the extended position, the angle θ between the front tension bar 56 and the rear tension bar 55 increases to approximately 155°. While the resistance force on the cable 76 remains constant, the movement of the second four bar linkage system 38, in conjunction with the first four bar linkage system 37, during a leg press increases the mechanical advantage from the perspective of the cable 76 and reduces the mechanical advantage of the user.

Figure 17A:
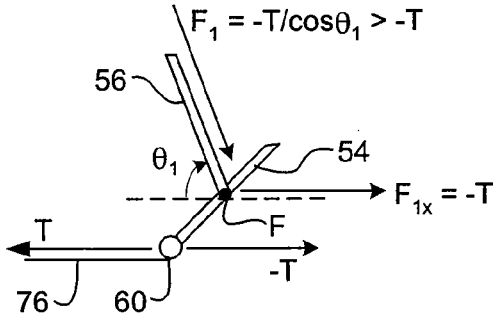
FIGS. 17A-B are geometric representations of the decrease in mechanical advantage to a user of the exercise machine of the first embodiment of the invention while performing leg press.
Figure 17B:
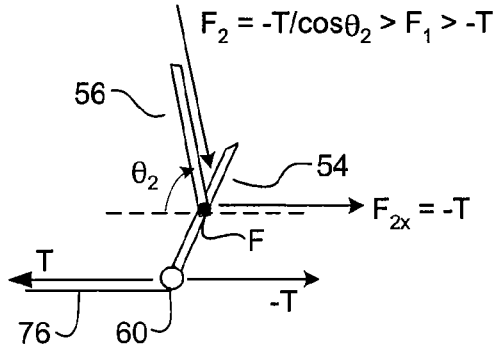
Figure 18:
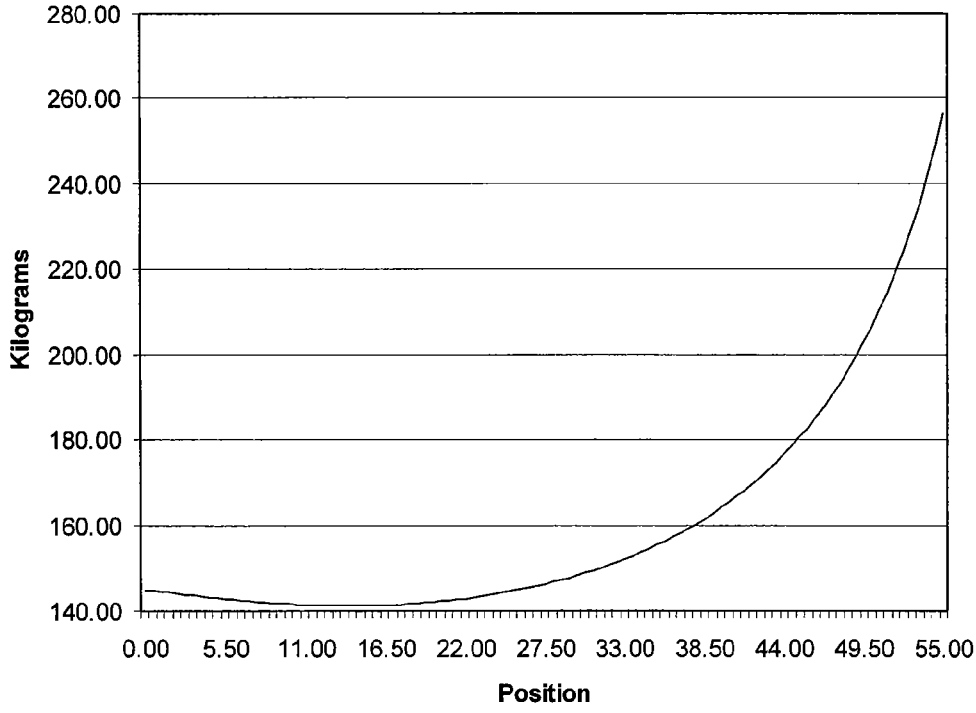
FIG. 18 is a graph of a force curve indicating the resistance force encountered by a user of the exercise machine of the second embodiment of the invention while performing leg press.

The reduction of the mechanical advantage of the user in the second embodiment is apparent through an analogous application of basic principles of physics as with respect to first embodiment. FIGS. 17A-B depict a simplified illustration of the decrease in mechanical advantage to a user created by the combination of the first four bar linkage system 37 and the second four bar linkage system 38 of the second embodiment. FIG. 18 shows the decrease in mechanical advantage to the user translated into an increasing force curve throughout the extension of a user's legs during a leg press exercise. FIG. 17A is a simplified representation of the forces acting on the leg press portion 3 in the resting position of FIG. 9. Cable 76 provides tension T on the leg press pulley 60. In order to counteract the force of tension T, at least an equal and opposite opposing force of −T must be applied to the leg press pulley 60. Leg press pulley 60 is mounted on the lower end of the front tension bar 56 and an intermediate location of the front tension bar 56 is connected to the rear tension bar 55 at pivot point F.

A force may be applied to the top of the rear tension bar 55, and transferred at pivot point F to the font tension bar 56 to leg press pulley 60 at the lower end of the front tension bar 56, into the desired opposing force −T. This force $F_1$ is supplied by the rear tension bar 55 pushing downward and forward against the front tension bar 56 at pivot point F. Force $F_1$ is, however, at an angle $\theta_1$ to the horizontal direction of tension T. Therefore, only the horizontal component $F_{1x}$ of force $F_1$ is able to act in opposition to tension T. The magnitude of force $F_1$ with a horizontal component $F_{1x}$ equal to −T is $-T/\cos\phi_1$, which is a force greater than tension −T. The force $F_1$ is supplied by the user pressing against the foot plate, which is translated both through the first four bar linkage system 37 and the second four bar linkage system 38 to the leg press pulley 60 lower end of the front tension bar 56.

A simplified representation of the forces acting on the leg press portion 3 of the second embodiment of the exercise machine 1 in the extended position of FIG. 10 is shown in FIG. 17B to provide a comparison to the resting position forces and illustrate the resulting increase in the force curve. Assuming the same tension T on the leg press pulley 60, an opposing force −T, a force equal and opposite to T, must again be applied to the leg press pulley 60. This force may again be applied to the top of the rear tension frame 54 at pivot point E and translated through the pivot point F to the leg press pulley 60. The force $F_2$ is supplied by the front tension bar 56 pushing against the top of the rear tension bar 55. Force $F_2$ is, however, at an angle $\theta_2$ to the horizontal direction of tension T. Therefore, only the horizontal component $F_{2x}$ of force $F_2$ is able to act in opposition to tension T. The magnitude of force $F_2$ with a horizontal component $F_{2x}$ equal to −T is $-T/\cos\phi_2$, which is a force greater than tension −T. As angle $\theta_2$ is greater than angle $\theta_1$, force $F_2$ is also greater than $F_1$.

As indicated, the representations of FIGS. 17A-B are greatly simplified and do not take into account the effect on the magnitude of forces required to counter tension T, for example, by the angle of incidence of the force provided by the user's legs, the torque advantage of the front tension bar 56 due to pivot point F, the instantaneous changes in configuration of the first four bar linkage system 37 and the second four bar linkage system 38, and the interaction between the first four bar linkage system 37 and the second four bar linkage system 38. However, the design of the exercise machine 1 does account for such factors and results in a force requirement on the user that is greater than the tension on the cable 76 and that continuously increases as the leg press portion 3 moves from the resting position to the extended position.

FIG. 18 shows the decrease in mechanical advantage to the user translated into an increasing force curve throughout the extension of a user's legs during a leg press exercise using the exercise machine 1 of FIGS. 8-14. In the exemplary leg press exercise depicted by the graph of FIG. 18, a 90 kg mass was attached to the cable 76 and was acted upon by gravity to provide a constant resistance force. The horizontal axis indicating position is the position of the foot plate 39 during an extension movement. Rather than indicating an actual distance, understanding that the foot plate 39 is moving about an instantaneous axis, the position axis indicates equal time increments of a constant movement from the start position as shown in FIG. 9 to a fully extended position as shown in FIG. 10. As indicated in the graph of FIG. 18, the combination of the first four bar system 37 and the second four bar system 38 increases the effective force required of a user at the start position from 90 kg (under gravity) to approximately 145 kg (under gravity). Further, as the user extends his legs through the exercise, the effective force required to counter the resistance force is generally constantly increasing, up to approximately 255 kg (under gravity) at the completion of a leg extension. As is evident from a comparison of the force curves of FIGS. 16 and 18, the exercise machine 1 of the embodiment of FIGS. 8-10 provides a greater mechanical disadvantage to the user than the exercise machine 1 of the embodiment of FIGS. 1-7, and thereby provides a more intense exercise experience.

Figure 19:
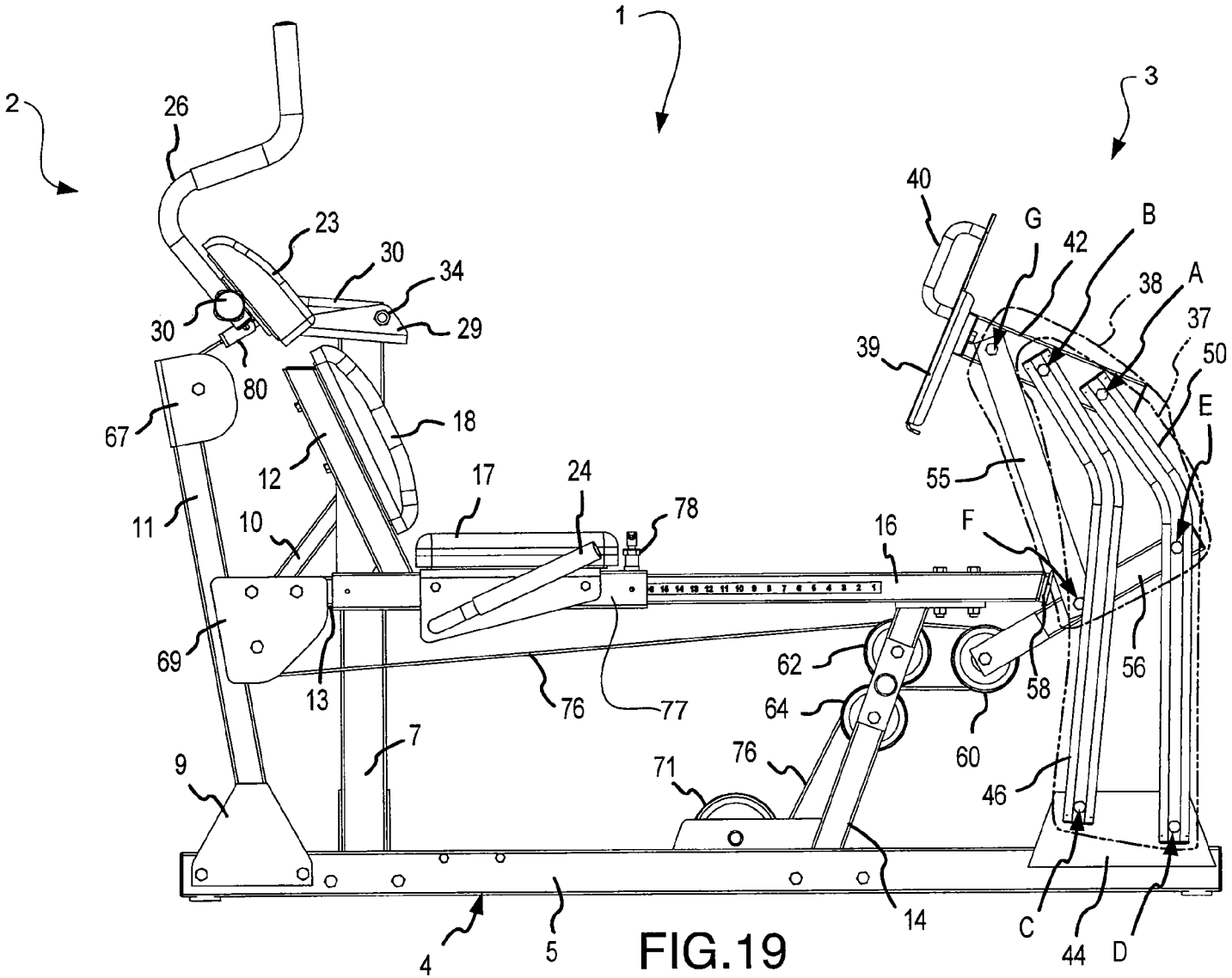
FIG. 19 is an isometric view of an exercise machine according to a third embodiment of the invention.

A third embodiment of the exercise machine 1 of the present invention is depicted in FIG. 19. This embodiment is configured for use, for example, with a circuit weight stack. The exercise machine 1 is built upon a frame 4. The frame 4 is composed of several sections, including a base rail 5, a handlebar post attachment rail (not shown), a handlebar support post 7, a rear support post 11, a rear support plate 9, a rear seat post 12, a front seat post 14, and a seat bar 16. The various bars and post that compose the frame 4 may be, for example, straight, tubular (e.g., round or square), metal (e.g., steel) beams that are attached together, for example, with brackets and through bolts. Such brackets may be separate pieces or integral with the various bars and posts.

The base rail 5 is the foundation of the frame 4 and generally rests flat upon a floor surface. The base rail 5 generally extends generally the length of the exercise machine 1 as shown in FIG. 19. This embodiment of the exercise machine 1 is generally attached to a circuit weight stack unit by lateral support rails (not shown) to prevent the exercise machine 1 from tipping over onto either the left or right side.

The handlebar post attachment rail (not shown) extends from the right side of the base rail 5 and physically connects the exercise machine 1 to the handlebar support post 7. A rear stabilizer bar 10 may be attached to or integral with the handle bar support post 7 and angle rearward and downward to connect with the seat support extension 13, in this case mostly concealed by a bottom rear pulley cover 69. The rear stabilizer bar 10 may further provide additional lateral stabilization for the exercise machine 1.

The front seat post 14 may be attached, generally medially, to the base rail 5 to extend upward. The seat bar 16 is supported by and attached to the front seat post 14 and the rear support post 12. The rear support post 12 may have a seat support extension 13 extending toward the front of the exercise machine 1 for attachment to the seat bar 16. The seat bar 16 may fit over and around the seat support extension 13 or vice versa. The rear seat post 12 may be attached to the seat bar 16 toward the rear end of the seat bar 16 and extend upward.

The seat bar 16 may further support a seat slide 77 covered by the seat pad 17 upon which a user may sit while performing exercises on the exercise machine 1. The seat slide 77 may be engaged with the seat bar 16 by a seat pop pin 78 that fits into any of multiple apertures along the top of the seat bar 16. The user may move forward or backward by pulling the seat pop pin 78, sliding the seat slide 77 along the seat bar 16, and engaging the seat pop pin 78 at a desired location. The seat slide 78 may also support grip rails 24 attached along the left and right sides of the seat bar 78 and extending beyond the width of the seat pad 18. The grip rails 24 may be grasped by the hands of the user to provide support to the user while performing exercises on the exercise machine 1. Similarly, the rear seat post 12 may support a back rest 18 against which the user may lean when performing exercises.

The handlebar support post 7 may support an arm hinge plate 29, which in turn is operably mounted by abdominal arm hinge 34 to an upper abdominal arm 30. The upper abdominal arm 30 supports a handlebar 26 for grasping by a user to perform an abdominal crunch exercise. The handlebar 26 further supports a head rest 23, which is mounted thereon. A cable terminator 80 may be connected the back of the head rest 23, or alternately to the handlebar 26 or to the upper abdominal arm 30. The cable terminator 80 acts as a termination point for a cable 76 connected through a pulley system (as described in detail infra) to a resistance force, e.g., a weight stack.

The upper abdominal arm 30 may be bent at an angle, for example, at approximately 90°, along its length to reach from the handlebar support post 7 to a position above and behind the back rest 18. In this manner, the abdominal arm hinge 34 is positioned further toward the front of the exercise machine 1 than the rear seat post 12 at the same height. The user may grasp the handlebar 26 with his hands above his head. The positioning of the abdominal arm hinge 34 allows the head rest 23 to remain behind the head of a user, and the handlebar 26 to maintain a constant positional relationship with the head rest 23, during the movement of an abdominal crunch exercise as the user bends his head and upper body toward his legs. The cable 76 provides resistance against the user as he pulls on the handlebar 26 during the abdominal crunch exercise. While the arm hinge plate 29 remains fixed atop the handlebar support post 7, the upper abdominal arm 30 rotates about the abdominal arm hinge 34, allowing the user's arms to move forward and downward while remaining over the user's head during the exercise.

The leg press portion 3 of the exercise machine 1 is of a similar design to the leg press portion 3 of the second embodiment of FIGS. 8-14. As in the second embodiment, the leg press portion 3 of the exercise machine 1 is mounted on the frame 4 in front of the front seat post 14. Similarly, the leg press portion 3 according to the second embodiment of the exercise machine 1 is composed primarily of a first four bar linkage system 37, a second four bar linkage system 38, and a structure for engaging the feet or lower legs of the user, again depicted as a foot plate 39. In the second embodiment, the first four bar linkage system 37 may be formed by two pairs of generally vertically oriented bent bars: a left rear bar 46, a right rear bar (not shown), a left front bar 50, and a right front bar (not shown); a foot plate bar 42; and a riser frame 44. The left rear bar 46 and the right rear bar (not shown) may together be considered one of the four sides of the first four bar linkage system 37. In one exemplary embodiment, the distance between pivot point B and pivot point C may be approximately 74.3 cm. The left rear bar 46 and the right rear bar (not shown) may each be bent at approximately a 143° angle with a vertex located approximately 55.2 cm from pivot point C and approximately 20.9 cm from pivot point B. Similarly, the left front bar 50 and the right front bar (not shown) may together be considered another of the four sides of the first four bar linkage system 37. In the exemplary embodiment, the distance between pivot point A and pivot point D may be approximately 74.3 cm. The left front bar 50 and the right front bar (not shown) may each be bent at approximately a 143° angle with a vertex located approximately 55.2 cm from pivot point D and approximately 20.9 cm from pivot point A.

The top ends of the left rear bar 46, the right rear bar (not shown), the left front bar 50, and the right front bar (not shown) of the third embodiment may each be pivotally attached, generally transverse to the foot plate bar 42. The left front bar 50 and the right front bar (not shown) may be attached directly opposing each other on opposites sides of the foot plate bar 42 on an axel through the foot plate bar 42 at pivot point A. Likewise, the left rear bar 46 and the right rear bar (not shown) may be attached directly opposing each other on opposites sides of the foot plate bar 42 on an axel through the foot plate bar 42 at pivot point B. In the exemplary embodiment, the distance between pivot point A and pivot point B may be 10.7 cm. The bottom ends of the left rear bar 46, the right rear bar (not shown), the left front bar 50, and the right front bar (not shown) may each be pivotally attached, generally transverse to a portion of the riser frame 44. The left rear bar 46 and the right rear bar (not shown) may be attached directly opposing each other on opposites sides of the riser frame 44 on an axel through the riser frame 44 at pivot point C. Likewise, the left front bar 50 and the right front bar (not shown) may be attached directly opposing each other on opposites sides of the riser frame 44 on an axel through the base riser frame 44 at pivot point D. In the exemplary embodiment, the distance between pivot point C and pivot point D may be 16.4 cm. The distance between pivot points C and D is greater than the distance between pivot points A and B.

The riser frame 44 may be mounted on or integral with the base rail 5. The riser frame 44 may be composed of two flat panels on each side of and extending above the base rail 5. The riser frame 44 may be used to provide clearance between the bottoms of the left rear bar 46, the right rear bar 48, the left front bar 50, and the right front bar 52 of the first four bar linkage system 37 and the floor on which the exercise machine 1 may rest. The riser frame 44 may further provide for a vertical offset between pivot point C and pivot point D to affect the motion of the first four bar linkage system 37, the mechanical advantage of the second four bar linkage system 38, or both as desired. In this third exemplary embodiment, the vertical offset between pivot point C and pivot point D is approximately 4 cm.

The foot plate 39 may be fixedly mounted to the rear end of the foot plate bar 42. A foot plate handle 40 may be provided on the foot plate 39 for aiding the user in mounting the exercise machine 1. When a user places his feet against the foot plate 39 in the resting position, the lower legs of the user (i.e., between the knees and ankles) should be normal to the plane of the foot plate 39. The seat slide 77 may be adjusted forward or backward along the seat bar 16 to help appropriately position the user and the user's legs vis-à-vis the foot plate 39. When the user extends his legs, the first four bar linkage system 37 defines a movement about an instantaneous (i.e., constantly changing) axis of rotation that maintains the foot plate 39 in a position normal to the lower legs of the user. That is, the angle of inclination of the foot plate 39 changes throughout the back and forth movement of the leg press exercise to maintain a position normal to the user's lower legs. In this manner, the first four bar linkage system 37 of the exercise machine 1 is able to better focus the resistance force on the desired muscle groups of the user throughout the entire movement of the leg press exercise.

A second four bar linkage system 38 is operably connected to the first four bar linkage system 37. The second four bar linkage system 38 is also operably connected with the cable 76, and thereby with the resistance force, and is designed to create a positive or increasing force curve throughout the extension of the user's legs during a leg press exercise. Stated in another way, the second four bar linkage system 38 operates to decrease the mechanical advantage of the user as the user extends his legs during the leg press exercise. Conversely, the second four bar linkage system 38 increases the mechanical advantage of the resistance force as applied through the cable 76.

The second four bar linkage system 38 may actually be formed from part of the first four bar linkage system 37. In the third embodiment of the exercise machine 1 of FIG. 19, the second four bar linkage system 38 is composed of a rear tension bar 55, a front tension bar 56, a portion of each of the left rear bar 46 and the right rear bar (not shown), and the foot plate bar 42. The front tension bar 56 is operably mounted to the rear tension bar 55 at pivot point F, for example, with a bolt or hinge, and similarly operably mounted between the left front bar 50 and the right front bar (not shown) at pivot point E between the top and the bottom of the left front bar 50 and the right front bar (not shown). In this exemplary embodiment, pivot point E is located approximately 47.3 cm from pivot point D and the distance between pivot point E and pivot point F along the front tension bar 56 is approximately 19 cm. The rear tension bar 55 is also operably mounted to the foot plate bar 42 at a pivot point G, which in this exemplary embodiment is located approximately 20.2 cm apart from point A. In this exemplary embodiment, the distance between pivot points G and F along the rear tension bar 55 is approximately 45.7 cm.

The third member of the second four bar linkage system 38 is composed of the portions of the left front bar 50 and right front bar (not shown) between pivot point A and pivot point E, which in this exemplary embodiment are approximately 28.9 cm apart. The fourth member of the second four bar linkage system 38 is the foot plate bar 42 between pivot point A and pivot point G. The pivot points and the lengths of the components of the first four bar linkage system 37 and the second four bar linkage system 38 may be altered or modified as desired to vary the resultant force curve and change the level of mechanical disadvantage to the user.

A leg press pulley 60 may be rotationally mounted on a shaft at the rearward extending end of the front tension bar 56, below pivot point F for operable connection with the cable 76 to supply the resistance force to the leg press portion 3 of the exercise machine 1. The front end of the seat bar 16 may have a stop bumper 58 for engaging the front tension bar 56 to impede the motion of both the first four bar linkage system 37 and the second four bar linkage system 38 in the rearward direction. When the front tension bar 56 engages the stop bumper, the leg press portion 3 of the exercise machine is in the resting position.

As previously indicated, the resistance force provided by the exercise machine 1 may be in the form of a weight stack (not shown) or other resistance system. The weight stack may be operably connected to both the abdominal crunch portion 2 and the leg press portion 3 of the exercise machine 1 by a single cable 76. At a first end the cable 76 is connected to cable termination 80 mounted to the head rest 23 such that the first end of the cable 76 is pulled by and moves with the head rest 23 and handlebar 26 during an abdominal crunch exercise. The cable 76 is threaded along a top rear support post pulley (not shown) hidden underneath the top rear pulley cover 67. The top rear support post pulley (not shown) is rotationally mounted on an axel near the top of the rear support post 11. The cable 76 is threaded down and within the rear support post 11 to a bottom rear seat post pulley (not shown), which is hidden underneath the bottom rear pulley cover 69. The bottom rear seat post pulley (not shown) is rotationally mounted on an axel near the bottom of the rear support post 11, where the direction of the cable 76 is changed. From the bottom rear seat post pulley (not shown), the cable 76 is routed under the seat bar 16 and threaded over the top of a top front seat post pulley 62, which is rotationally mounted on an axel near the top of the front seat post 14. The cable 76 is then threaded over the leg press pulley 60, whereby the cable 76 is directed in the opposite direction toward the rear of the exercise machine 1.

The cable 76 is then threaded over the top of a bottom front seat post pulley 64, which is rotationally mounted on an axel near the bottom of the front seat post 14, and again routed under the seat bar 16 and downward to a base rail pulley 71. The cable 76 is then threaded around the base rail pulley 71 an into the base rail 5. A horizontal pulley (not shown) is mounted within the base rail 5 to translate the direction of the cable 76 out an opening (not shown) in the right side of the base rail 5 toward a weight stack (not shown) on the right side of the exercise machine 1 to be connected to the resistance force directly, e.g., a weight stack, or to be connected to a secondary cable (not shown) that is in turn connected to the resistance force.

Although various embodiments of this invention have been described above with a certain degree of particularity, or with reference to one or more individual embodiments, those skilled in the art could make numerous alterations to the disclosed embodiments without departing from the spirit or scope of this invention. It is intended that all matter contained in the above description and shown in the accompanying drawings shall be interpreted as illustrative only of particular embodiments and not limiting. Changes in detail or structure may be made without departing from the basic elements of the invention as defined in the following claims.

The invention claimed is:

1. A force conditioning device comprising:

a first four bar linkage system including a first top bar and at least one rear bar;

a second four bar linkage system operably connected to the first four bar linkage system, the second four bar linkage system including a second top bar positioned underneath the first top bar;

the first and second four bar linkage systems operating to provide a mechanical advantage to a resistance means acting on the device in opposition to a force acting on the device, at least three bars of each of the first and second four bar linkage systems pivotally connected in a direct pivotal relationship to at least one other bar of the first and second four bar linkage systems;

the second top bar including a flexible member connection portion extending beyond the at least one rear bar in a direction generally away from the other bars of the first four bar linkage; and a flexible member directly associating the resistance means with the flexible member connection portion of the second top bar.

2. The device of claim 1, wherein a portion of the first four bar linkage system comprises a portion of the second four bar linkage system.

3. The exercise device of claim 1, wherein the flexible member comprises a cable.

4. The exercise device of claim 1, wherein the resistance means comprises a weight stack.

5. The device of claim 1, wherein each bar of each of the first and second four bar linkage systems is pivotally connected in a direct pivotal relationship to at least one other bar of the first and second four bar linkage systems.

6. An exercise machine comprising:

a frame;

a means for transferring an incident force from the legs of a user;

a first four bar linkage system operably mounted to the frame and operably connecting the transferring means to the frame, the first four bar linkage system for allowing back and forth movement of the transferring means along a path of travel about an instantaneously changing axis of rotation and for changing the angle of inclination of the transferring means to maintain the transferring means in a position normal to the length of the lower legs of the user during a corresponding leg extension movement of the user;

a second four bar linkage system operably engaging the first four bar linkage system, at least three bars of each of the first and second four bar linkage systems pivotally connected in a direct pivotal relationship to at least one other bar of the first and second four bar linkage systems;

the first four bar linkage system including a first top bar and at least one rear bar;

the second four bar linkage system including a second top bar positioned underneath the first top bar;

the second top bar including a flexible member connection portion extending beyond the at least one rear bar in a direction generally away from the other bars of the first four bar linkage;

a resistance means; and a means for directly connecting the flexible member connection portion of the second top bar to the resistance means, the means for operatively connecting comprising a flexible member; wherein the second four bar linkage system operates in conjunction with the first four bar linkage system and the resistance means to create a mechanical disadvantage to the user.

7. The exercise machine of claim 6, wherein the mechanical disadvantage comprises a continual increase in the incident force required of the user to exert on the transferring means during the leg extension movement to counteract a constant force exerted by the resistance means.

8. The exercise machine of claim 7, wherein the constant force exerted by the resistance means is translated through the second four bar linkage system and the first four bar linkage system as an opposing force substantially normal to the transferring means and substantially opposite the incident force.

9. The exercise machine of claim 6, wherein the second four bar linkage system is further operably engaged with at least one of the transferring means and the frame.

10. The exercise machine of claim 6, wherein a portion of the first four bar linkage system comprises a portion of the second four bar linkage system.

11. The exercise machine of claim 6, wherein a portion of the first four bar linkage system comprises a portion of the transferring means.

12. The exercise machine of claim 6, wherein a portion of the first four bar linkage system comprises a portion of the frame.

13. The exercise machine of claim 6, wherein the resistance means comprises a weight stack.

14. The exercise machine of claim 6, wherein the means for operably connecting further comprises the flexible member threaded through a pulley system, and wherein at least a portion of the pulley system is operably mounted on the frame.

15. The exercise machine of claim 14, wherein a portion of the pulley system is operably mounted to the flexible member connection portion of the second top bar.

16. The exercise machine of claim 14, wherein the flexible member comprises a cable.

17. The exercise machine of claim 6, wherein each bar of each of the first and second four bar linkage systems is pivotally connected in a direct pivotal relationship to at least one other bar of the first and second four bar linkage systems.

* * * * *